US011465022B2

(12) United States Patent
LeHardy

(10) Patent No.: US 11,465,022 B2
(45) Date of Patent: Oct. 11, 2022

(54) GOLF GAME UMBRELLA APPARATUS

(71) Applicant: Louis LeHardy, Roanoke, VA (US)

(72) Inventor: Louis LeHardy, Roanoke, VA (US)

( * ) Notice: Subject to any disclaimer, the term of this patent is extended or adjusted under 35 U.S.C. 154(b) by 200 days.

(21) Appl. No.: 16/573,984

(22) Filed: Sep. 17, 2019

(65) Prior Publication Data

US 2020/0094120 A1 Mar. 26, 2020

(30) Foreign Application Priority Data

Sep. 21, 2018 (GB) ..... 1815381.7

(51) Int. Cl.

| | |
|---|---|
| ***A63B 67/02*** | (2006.01) |
| ***A63B 57/30*** | (2015.01) |
| ***A63B 57/40*** | (2015.01) |
| ***A63B 63/08*** | (2006.01) |
| ***A63B 67/06*** | (2006.01) |
| ***A63B 69/36*** | (2006.01) |

(52) U.S. Cl.

CPC ..... *A63B 67/02* (2013.01); *A63B 57/357* (2015.10); *A63B 57/40* (2015.10); *A63B 63/08* (2013.01); *A63B 67/06* (2013.01); *A63B 69/3623* (2013.01)

(58) Field of Classification Search

CPC ..... A63B 57/357; A63B 57/40; A63B 63/08; A63B 67/06

See application file for complete search history.

(56) References Cited

U.S. PATENT DOCUMENTS

| | | | | |
|---|---|---|---|---|
| 4,336,939 | A * | 6/1982 | Krumlauf | A63F 7/0628 473/183 |
| 4,711,260 | A * | 12/1987 | Wiens | A45B 3/00 135/16 |
| 6,083,114 | A * | 7/2000 | Bailey | A63B 57/357 473/196 |
| 7,311,617 | B2 * | 12/2007 | Langhorn | A63B 63/00 473/446 |
| 7,794,341 | B2 * | 9/2010 | Tarng | A63H 33/18 473/465 |
| 8,282,509 | B1 * | 10/2012 | Michaelson | A63B 69/36 473/456 |
| 2003/0008721 | A1 * | 1/2003 | Macaluso | A63B 69/36 473/197 |
| 2003/0078111 | A1 | 4/2003 | Wenzler | |
| 2004/0244249 | A1 * | 12/2004 | Zheng | G09F 15/0037 40/610 |
| 2008/0194350 | A1 * | 8/2008 | Yoon | A63B 63/00 473/197 |
| 2009/0143175 | A1 | 6/2009 | Tarng et al. | |
| 2010/0081513 | A1 * | 4/2010 | La Pointe | A63B 63/00 473/197 |
| 2017/0157485 | A1 * | 6/2017 | Esser | A63B 69/0097 |

FOREIGN PATENT DOCUMENTS

| | | | | |
|---|---|---|---|---|
| CA | 785654 | A | 5/1968 | |
| CA | 2746313 | A1 * | 1/2013 | A63B 67/06 |
| JP | H0355722 | U | 5/1991 | |
| WO | 2004028648 | A1 | 4/2004 | |

* cited by examiner

*Primary Examiner* — Joshua T Kennedy

(57) ABSTRACT

An apparatus comprises a shaft; an openable and closable canopy; and a plurality of upwardly extending holding chambers on an underside of the canopy. The apparatus is thought to be particularly useful as a golf chipping game, with golf balls being chipped into the holding chambers as target practice.

25 Claims, 5 Drawing Sheets

GOLF GAME UMBRELLA APPARATUS

The present invention relates to an apparatus, preferably for use as a golf chipping practice game. However, other items (other than golf balls) can be projected towards the apparatus. Therefore it is not limited to use as a golf game.

Terms/Definitions

'Arrangement':

The term arrangement is a technical term which means a feature, or combination of features, (usually with a given purpose). For example, a 'measuring arrangement' is a feature or features, to facilitate measuring. A 'holding arrangement' is a feature or features, to facilitate holding.

'Feature':

The term 'feature' is a broad term that includes within its scope any feature under the Sun. A feature may, for example, be an element, body, member, or may even be an aperture (eg opening/hole/gap or the such like). Thus the term 'holding feature' includes within its scope, for example, any element, body, member, or even aperture, to facilitate holding. A 'feature' may also be a 'part' of a broader feature; for example, if a part of an invention is disclosed/claimed as comprising a 'padding feature', this does not limit the padding feature to being a separate feature that is added to the invention (eg a sponge element, adhered to the invention); the invention, for example, may have a part made of sponge, or have an inner sponge (or soft) layer—in such a case, if that part of the invention is clearly of a material/nature that provides padding, then this falls within a scope of what is defined in the present application as a 'padding feature'.

'Substantially':

It is known, to those with skill in the art of patenting, that the word 'substantially' can, in some instances, be used to broaden a term. It should be stated that, in the present application, use of the word 'substantially' with a term, to define a (characterizing) feature(s), gets all the benefit (ie the benefit of any broadening) afforded by use of the word 'substantially', and also includes within its scope the feature(s) being that term exactly, (without broadening). For example, if two features are described/defined in the present application as being 'substantially parallel', then that includes, within its scope, the features being 'close' to parallel (in so far as the word 'substantially' is deemed to broaden the term 'parallel'), and also includes within its scope the features being 'exactly' parallel).

'Velcro®' and 'Velcro®-Type':

It will be known that the term 'Velcro®' has become synonymous (in layman's terms) for hook-and-hook, hook-and-loop, loop-and-loop, and all such similar attachment solutions. In the present application, where the term 'Velcro®' is used, in includes within its scope all of the above, and whatever solutions would be considered to be, from a layman's point of view, 'Velcro®'. Thus it is a broad term. The term 'Velcro®', or 'Velcro®-type', may be used, (in the disclosure generally, and may also be used in a claim(s)), and is thus a broad term which includes within its scope any solutions/features which would be considered, from a layman's point of view, to be 'Velcro®'.

'Attached' and 'Connected':

If a feature (or two features) are defined in a claim as being attached, that would include within its scope the feature (or two features) being permanently attached, (of course), and would also include within its scope the feature (or two features) being removably attachable, (because, if removably attachable, the feature (or two features) can be attached, and therefore, when attached, would be within a scope of being 'attached'). Furthermore, the feature (or two features) being defined in a claim as being 'attached' would also include within its scope the feature that is defined as being 'attached' being formed as one part with a portion or a whole of the other feature it is defined as being 'attached' to. For example, if a table leg is defined in a claim as being 'attached' to a table top, that would include within its scope the table leg being formed as one part with a whole of the table top (eg if the table leg and table top were formed as one piece of plastic, for example) and would also include within its scope the table leg being formed as one part with a portion (rather than a whole) of the table top (eg if the table top was formed of more than one part, and the table leg was formed as one part with a part of the table top, but not a whole of it).

It should be noted, some (few) patent offices require structural connection/relationship terms (in claims), to define structural connection/relationship between features of the claim. With this in mind, (and if it should be required, although it often is not), the term 'connected', if used in a claim, is a broad term, which includes within its scope direct connection, and also includes within its scope indirect connection. ('Direct' connection would be where two features, for example, are directly connected to each other (eg an arm is 'directly' connected to a shoulder). 'Indirect' connection would be where two features, for example, are connected, but via intermediate feature(s) (eg a person's foot is 'connected' to their head, but 'indirectly', (via their leg, abdomen, torso, etc, which are 'intermediate features')). Where the term 'connected' is used in a claim, it includes within its scope 'direct' connection, and also includes within its scope 'indirect' connection. The term may be used in a claim, (and is deemed supported), whether 'direct' and/or 'indirect' connection embodiment(s) is (/are) disclosed in the present application, and, as stated, includes within its scope 'direct' connection, and also includes within its scope 'indirect' connection. Furthermore, if a feature(s) is (/are) defined as being 'connected', that would include within its scope the (or any—ie more than one of the said) feature(s) being removably attachable, if, when attached, the feature(s) is (/are) in a state of being 'connected', (directly or indirectly). Thus if a first feature is defined as being 'connected' to a second feature, it would include within its scope the first feature and/or the second feature being removably attachable, if, when attached, the first feature is connected to the second feature, (directly or indirectly). Furthermore, of course, (and similarly to the word 'attached'), if a feature (or two features) are defined in a claim as being 'connected' it would also include within its scope the feature that is defined as being 'connected' being formed as one part with a portion or a whole of the other feature it is defined as being 'connected' to.

'The or Each' and 'the or Any':

The term 'the or each' (either in disclosure and/or a claim) can refer back to a single feature/thing, and/or can refer back to a plurality of features/things. When the term is read as referring back to a plurality of features/things, it should be taken as meaning, and including within its scope, 'at least one, or more, or all (ie each)' of the said features/things. Thus, to give an example, if a square is referred to/disclosed that has four corners, if the term 'the or each corner' is used, it includes within its scope 'one of the corners, (or two, or three, or all of the corners)'.

When any one feature/thing is afforded any feature(s)/definition in the present application, it is taken as read that, where a plurality of the said feature/thing is provided, 'the or each' said feature/thing may be provided/claimed comprising the said feature(s)/definition (ie at least one, or more or all). Similarly, wherever a plurality of the said feature/thing are afforded any feature(s)/definition, it is taken as read that 'the or each' said feature/thing may be provided/claimed comprising the feature(s)/definition (ie at least one, or more, or all of the plurality), and/or that even just one said feature/thing may be provided/claimed comprising the feature(s)/definition in an embodiment/claim wherein an invention is defined as comprising 'a' (eg singular) said feature/thing.

(The term 'the or any' may be used (again including within its scope, 'at least one, or more, or all (ie each)', instead of the term 'the or each').

'User Means':

It will be well known that, in certain patenting territories, (for example, the United States), use of the term 'means' or 'means for', if used in a (granted) patent claim, can be seen as a limiting term, limited to only giving the applicant/proprietor of the patent protection of means that are disclosed in the granted patent, or 'equivalent' means. This is not the case with the term 'user means' as it is used in the present application. The term 'user means' is a very broad term that is used in the field of product design/user-interface, and defines any means under the sun, provided for a user, for whatever action/result the user means is provided for. For example—a 'user means' to turn on a television could be provided by way of an ON/OFF button on the television. But it could also be provided by a button on a remote control which turns on the television when pressed. Both of these would fall (in the technical field of product design/user-interface) under the scope of the term 'user means' to turn on the television. Similarly, with certain inventions/products, a 'user means' may be provided to 'initiate' an action, for example. Thus, in the present application, a claim that defines an invention which comprises a 'user means' for [a particular action/result] is not subject to any 'means for' limitations that certain patent office territories (such as the United States) may appropriate to the term 'means for', but should be read as (and given protection for, if granted) any means under the sun, provided for a user, for [that particular action/result defined]. 'User means' is a technical term in the field of product design/user-interface.

Reference to Multiple Similar Elements in Plural

In the present application, there may be provided/numbered features wherein the same primary number is used, with a suffix. For example, a first side of the/an invention may be numbered 600', and a second side of the/an invention numbered 600". In any such case (or where any other suffix is used, such as 'L' and 'R' to denote 'left' and 'right', or 'a' and 'b', for example), when such features are referred to together (ie 'the sides'), the plural may be numbered/referred to with the primary number (without the suffix). Thus the first side 600' and second side 600" may, for example, be referred to simply as 'the sides 600'. Furthermore, if a side is referred to (not specifying which one of the sides), the primary number (ie 600, for example) may be used, without any suffix.

BACKGROUND

Golf is played by millions of players around the world. Many games have been devised to help with golf chipping. However, some of them are over-ornate and/or may be problematic in terms of storage and/or portability, and/or do not particularly reward the player for accurate chipping.

SUMMARY

The present invention is defined by the accompanying claims, to which reference should now be made.

Examples of the present invention seek to provide a solution to any or all of the above problem(s) by providing, according to one aspect of the invention: an apparatus, comprising: a shaft; an openable and closable canopy; and a plurality of upwardly extending holding chambers on an underside of the canopy.

The apparatus is preferably used as a golf game, to allow players to chip balls (via use of a golf club to chip the balls with) into the holding chambers. (However, it could be used for other purposes, eg in other games which involve aiming projectiles into or towards the apparatus. These are not limited to golf, and may include, for example, throwing (and/or projecting in any way (eg hitting)) of any type of projectile(s) into or towards the apparatus).

The chambers (as will be explored) may be arranged in such a way that can reward players who accurately chip the ball into/towards the apparatus.

The apparatus may comprise a cup element, (which can be used, for example, for the user to try to chip a golf ball into, thus making it even more like a golf shot/golf hole).

The apparatus may comprise a flag, which may thus make the game look even more like a golf flag (and golf hole) that the user is attempting to chip towards.

Preferably the apparatus is an umbrella apparatus. However, it should be stated, the apparatus may, or may not, look like and/or be an umbrella. For example, an embodiment may be provided, for example, with a basic shaft (eg a wooden shaft, for example), and an openable and closable canopy which may, for example, look more like a sun-shade (for example) than a typical umbrella looking apparatus or canopy. Such an embodiment may (spuriously or not) be argued not to be an 'umbrella'. Thus it is stated that the apparatus is preferably an umbrella apparatus, to make it clear that the scope is not limited (especially via use of arguable and/or spurious arguments) to being what would typically be considered to be (and/or look like) an 'umbrella'.

According to another aspect of the invention, there is provided: an apparatus, comprising: a shaft; and an openable and closable canopy. According to this aspect, the apparatus may, or may not, comprise a plurality of upwardly extending holding chambers on an underside of the canopy. It may draw upon, (and therefore comprise), any of the feature(s) disclosed in the present application. Thus it may, for example, comprise a cup element.

The second aspect (and/or any further/other aspect(s)) may comprise any of the feature(s) of the first aspect and may draw upon any of the feature(s) and/or disclosure of the present application, as optional and/or preferable feature(s). Any aspect may comprise any feature(s) of any other aspect(s), whether the feature(s) be essential or preferable and/or optional to the other aspect(s).

BRIEF DESCRIPTION OF THE DRAWINGS

Examples of the present invention will now be more particularly described, with reference to the accompanying drawings, by way of example only, in no way limiting a scope of the invention, in which.

Note: At some patent offices, when claim(s) are allowed for patent, it is required that Figures that do not show all the feature(s) of the/an invention claimed (and/or that are not within a scope of what is claimed) are denoted as 'not being claimed' or 'not within a scope of what is claimed' (or words to that effect). Even in such case, it will be apparent that such Figure(s) may or do show feature(s) that are essential, or preferable and/or optional, to the/an invention claimed, which will be apparent, in light of the disclosure. Thus such Figure(s) (and/or disclosure related to such Figure(s) and/or embodiment(s)), should nevertheless be considered relevant to the/an invention claimed.

DETAILED DESCRIPTION

Figure 1:
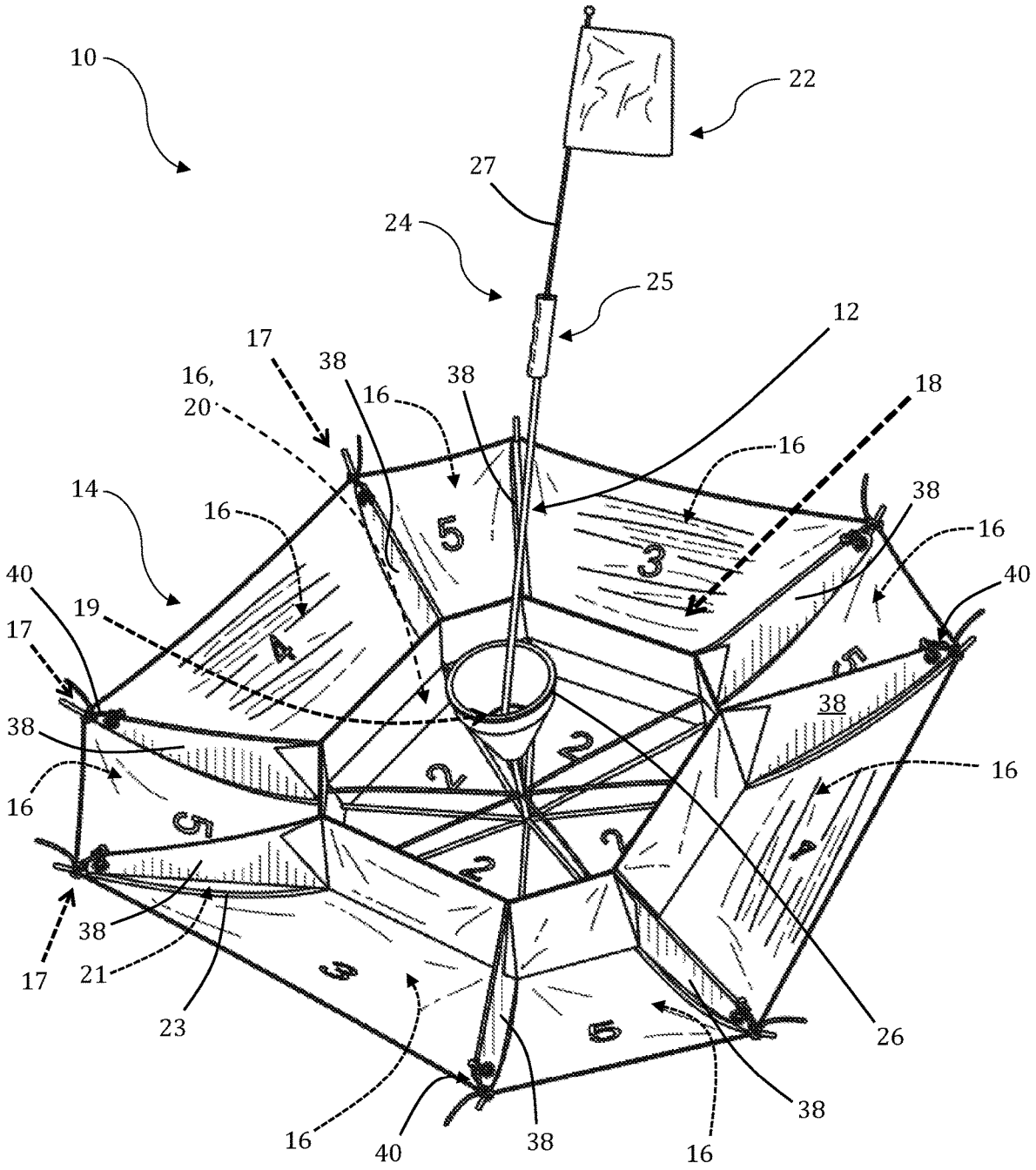
FIG. 1 is a perspective view of an example embodiment of an apparatus, upside down, with a canopy open, and showing a plurality of upwardly extending holding chambers on an underside of the canopy.

Referring to the drawings, there is shown an apparatus 10, comprising: a shaft 12; an openable and closable canopy 14; and a plurality of upwardly extending holding chambers 16 on an underside 18 of the canopy 14. (This is best shown in FIG. 1, where the apparatus can be seen upside down, (thus showing the underside 18 of the canopy 14, and where the holding chambers 16 are clearly visible).

(It should be noted, in the example embodiment(s) shown, the shaft is provided by way of one element. However, it is feasible a shaft could have multiple different (eg elongate) elements, that together form a shaft. This would be within a scope of being a shaft.)

Preferably the apparatus 10 is configured such that the (or any of the—ie one or more of the) plurality of upwardly extending holding chambers 16 on an underside 18 of the canopy extend, automatically, when the canopy 14 is opened. (This may be achieved via tension, for example, so that, simply via tension, the upwardly extending holding chambers 16 on an underside 18 of the canopy extend, automatically, when the umbrella 10 is opened). Thus preferably one or more of the holding chambers (and most preferably all of the holding chambers) are naturally erected, when the canopy opens. (This may be referred to as the (or any of the) holding chambers being 'self-erecting', when the canopy is opened).

Manual work/action (by the provider and/or the user) may, or may not, be required, prior to the or any holding chamber becoming self-erecting. For example, it is feasible, around point 17, for example (for any of the holding chambers—only several of such example points 17 are numbered in FIG. 1) that there may be a hook and hole configuration, (or any means of attachment), where the wall of the holding chamber can thus be attached (either comprising a hook that goes into a hole on the apparatus, or vice versa, comprising a hole that a hook of the apparatus can go through). This is just one example of how manual work may be required, before the (or any) holding chamber become self-erecting, in no way limiting the scope of how manual work may be required. (Connection methods other than a hook-and-hole method may be used, for example, such as clip(s), Velcro®-type connections, or any other method). (It should also be stated that such example attachment solutions (and, in fact, any attachment solution) may be provided for examples where the (or any of the, ie one or more of the) holding chambers are naturally erected (ie self-erecting) when the canopy opens. It should also be said, by way of example, that stitching may be used, in embodiments where one or more (and preferably all) of the holding chambers erect naturally, (ie are self-erecting), when the canopy is opened. For example, one or more (and preferably/possibly all) of the walls may be stitched (partly or wholly) to the canopy, for example, in such a way that they naturally erect, when the canopy is opened. This could be achieved, for example, via tension, with one or more of the walls stitched in such a way that tension erects them, when the canopy is opened. (In such examples (ie where stitching is used), it is not required that the whole of the wall is stitched to the canopy—for example, it is possible just part of the or any wall is stitched to the canopy. Thus, for example, similarly to how the walls/dividers, in the example of FIG. 1 for example, are generally attached at example points 17, so the or any of the walls could be attached (at similar point(s), for example) via stitching. In such an embodiment, the rest of the wall (ie at its underside for example, may, or may not, be stitched (along part of it, or a whole of it) to the canopy). Stitching is just one example of a permanent attachment solution (others could include glue, (or permanent adhesives of any sort), although adhesives may not be ideal to use for such a use), and thus not requiring action/work (from provider or user), for the holding chambers to be erected manually. (A portion or a whole of the or any of the wall(s) may be attached permanently, or removably attachably (and/or detachably)). In the example of FIG. 1, the walls that are attached generally at points 17 are, in the example, attached in a way that is detachable, (although they may be attached permanently). In the example, a knot(s) is used to attach them. In the example, the knot(s) may be untied, and thus a portion or a whole of the or any of the walls, in the example, are attached here detachably. Knot(s) (and/or being tied via cord element(s)) are just one example where attachment can be detachable. Other examples may include hook(s), clip(s), or any other detachable attachment mechanism(s)). However, in such examples, (eg as shown in the example embodiment of FIG. 1), although a portion or a whole of the or any wall may be detachable, once attached, the relevant holding chamber(s) are then self-erecting, because the canopy could be closed, and when re-opened, they would self-erect. (Thus this is an example embodiment of one or more of the holding chambers being self-erecting).

(It should be noted, a portion or a whole of any wall(s) may be attached to the canopy 'directly', or may be attached 'indirectly' (ie via intermediate feature(s)). Both of these are considered to be within a scope of a portion or a whole of the (or any) wall being 'attached to the canopy'. Thus, for example, if a portion of an example wall is attached to another wall, and the other wall is attached to the canopy, then the example wall (even if not attached to the canopy directly, itself), is nevertheless attached to the canopy, (in the example, 'indirectly', via the other wall). Thus this is within a scope of the example wall being 'attached to the canopy'. Similarly, if a portion of a wall is attached (eg generally at example point(s) 17), then even if it is attached via a hook, or ring, etc, (or any feature(s)), (rather than, for example, being stitched into (or attached directly in any way to) the canopy, for example), that is nevertheless an example of the portion of the wall being 'attached to the canopy'. Thus whether a portion or a whole of the wall is attached to the canopy directly, or indirectly, it is within a scope of a portion or a whole of the wall being 'attached to the canopy'.

The examples as shown, as stated, are examples of wherein the or any of the holding chambers are self-erecting, when the canopy is opened. However, it is feasible one, or more, (or all), of the upwardly extending holding chambers 16 on the underside 18 of the canopy may need to be put up manually, and may not be self-erecting. An example of a holding chamber not being self-erecting when the canopy is opened could be, for example, if a wall(s) is provided separately, as a separate piece, which must be manually put up every time (when the canopy is opened). For example, if a piece of wood (just given here by way of example, but could be made out of other material(s)) was provided, which is used as a wall(s) of a holding chamber(s)), and if the user manually has to put it up every time, when the canopy is opened, to form the wall(s), then that, of course, would be an example of that wall not being self-erecting when the canopy opens. (It is even feasible that the canopy could not be able to close when the wall(s), (ie the piece of wood, in this example), are in place (to form the holding chamber(s), and so the user removes it every time the canopy is to be closed (and then manually has to put it up every time, when the canopy is opened, to form the wall(s). (In such example(s), the or any wall(s) that require being put up manually may, or may not, remain attached to the apparatus, when the canopy is closed. (ie They may be fully removed (and either kept within the canopy, or separate from the rest of the apparatus, when the canopy is closed. Or they may in some way stay partially attached to the apparatus when the canopy is closed, for example, (and nevertheless require to be manually put up when the canopy is opened)).

Thus the or any wall may, feasibly, require being put up manually, and may not be self-erecting.

(It should also be stated that it is feasible a combination of self-erecting holding chamber(s) and holding chamber(s) that require being manually put up may be provided. Thus one or more of each may feasibly be provided, in the same embodiment).

As stated, preferably one or more of the holding chambers (and most preferably all of the holding chambers) are self-erecting, when the canopy opens. However, it should be stated that it is feasible one or more (or even all) of the wall(s) require being put up manually. Thus one or more (or even all) of the holding chambers may require being partially or wholly manually put up, (ie one or more wall of the or any holding chamber may require being manually put up). (Manual work to do this may be cumbersome. Therefore the holding chambers being self-erecting is thought to be highly preferable). As mentioned previously, a portion of one or more wall may be detachably attached. (An example of this is shown in the example embodiment of FIG. 1, generally at points 17). It is even feasible the or any wall is detachable ata plurality of points. (Either a portion of the or any wall may be detachable—eg with the wall staying attached, in some way, even when a portion of it is detached), or a whole of the wall may be detachable (eg with the whole wall being detachable/removable). Such embodiments may, nevertheless, be self-erecting if, once attached, they open naturally, when the canopy is opened.

Furthermore, as stated, it is feasible that self-erecting embodiments may be provided, wherein the or any wall is permanently attached (and not detachable at any point). An example of how this could be achieved would be stitching (eg a portion or a whole of the wall being stitched to the canopy), or it/they could be attached in any way, to any feature(s), that makes it non-detachable, (eg glue, or any permanent adhesive and/or permanent attachment method, etc).

Preferably, of the plurality of upwardly extending holding chambers 16, there is a central holding chamber 20, with other(s) of the plurality of holding chambers 16 around the central holding chamber 20. This is clearly shown in the embodiment of FIG. 1, where the example central holding chamber 20 can be seen, with a plurality of other holding chambers around it.

(It should be noted that, whilst, in the example, there are shown a plurality of holding chambers around the central holding chamber, it is feasible that there are not a plurality of holding chambers around the central holding chamber. For example, in the example, if there were no walls 38 (which may also be termed as 'dividers') for the holding chambers that surround the central holding chamber, then there would, effectively, be only one holding chamber that fully surrounds the central holding chamber. Thus, in such an example, there would only be two holding chambers, (ie there would only be the central holding chamber, and the holding chamber which surrounds and goes around the central holding chamber). (In such an example, therefore, the central holding chamber would form an 'inner' holding chamber, and outside of it could be said to be an 'outer' holding chamber, which surrounds it). This would nevertheless be an example embodiment, and within a scope of there being a plurality of (ie two or more) upwardly extending holding chambers on the underside of the canopy. (It should also be noted that, in such an example, it is feasible the wall(s) of the central holding chamber may nevertheless be connected to example points 17, for example, (or any other point(s)/location(s)), which may help erect the central holding chamber. (Thus the wall(s) may be self-erecting, and may be self-erecting in any way). Thus it could be erected via tension, whether it be automatically (when the canopy opens), due to build structure of the apparatus for example, or manually, etc. It could be connected (eg to points 17, or any other point(s)/location(s)) via a string, for example, or any cord element, (or any other feature(s)/arrangement), for example. And, for example, this could be done/provided, without there being any walls 38 (which may also be termed as 'dividers') for the holding chambers that surround the central holding chamber. (It should also be noted that the central holding chamber could, feasibly, be self-erecting in other ways, (other than being connected to example points 17, (or in similar ways). For example, a support feature(s) (eg one of the spokes, for example, in the example embodiments shown, or any other feature(s), could, when the canopy is opened, push (preferably slightly upwards) into the or any wall of the central (or any) holding chamber, thus erecting it. The support feature could then cease to push against the or any wall, when the canopy is closed. In such an example, the support feature may be 'collapsible', (similar to the example spokes, best shown in the example embodiment of FIG. 1 and FIG. 4). Thus there are various ways that a wall(s), (and that a holding chamber(s)) can be self-erecting, in no way limited to the examples shown.

(In the example mentioned/alluded to above, (eg an embodiment wherein there is only a central holding chamber, and only one holding chamber that fully surrounds the central holding chamber), if the central holding chamber is self-erecting, and if the central holding chamber is formed by just one wall around it, that would be an example of wherein just one wall is self-erecting, so that one or more of the holding chambers is self-erecting. (Thus it would be an example embodiment wherein at least one wall is self-erecting, to facilitate one or more of the holding chambers being self-erecting. (In such an example, it would be considered that both the central holding chamber, and the outer holding chamber around it, and both self-erecting, by virtue of the wall(s) of the central holding chamber being self-erecting, because, in such an example, the wall(s) provide definition for both the central holding chamber, and the outer holding chamber that surrounds it. Thus this would be an example of wherein at least one wall is self-erecting, to facilitate one or more of the holding chambers being self-erecting. This is just one example, and other examples of wherein at least one wall is self-erecting, to facilitate one or more of the holding chambers being self-erecting may be provided, not limited to the central holding chamber (and outer holding chamber) example given). However, as shown in the example embodiment of FIG. 1 for example, preferably a plurality of walls are self-erecting, to facilitate one or more (and preferably all) of the holding chambers being self-erecting).

Preferably some or all of the wall(s) (which may also be termed as 'dividers') of the holding chambers are stitched to the canopy. However, they may be provided in any way. They may be attached in any way. Stitching is a particularly good embodiment. However, other ways of attaching are possible. For example, in the example embodiment of FIG. 1, the wall of the example central holding chamber 16, 20 is provided in an L-shape configuration. The lower portion of the L-shape can be seen in FIG. 1. This may be attached in any way. However, in the example embodiment, it is attached via Velcro®. (More broadly speaking then, (not limited to the example shown), it should be said that any or all of the wall(s) of the holding chambers may be attached via Velcro®). Thus the lower portion of the L-shape is attached, via Velcro®, in the example, but such examples may be attached in any way. For example, the lower portion could be stitched. With reference to Velcro®, preferably, therefore the lower portion of the L-shape wall embodiment (or any portion of any wall) comprises a Velcro® surface(s). (This may be permanently attached to the (portion of) the wall, or may be removably attachable to it). Thus then preferably the canopy also comprises a Velcro® surface(s) that the Velcro® surface of the (portion of the) wall can mate to. (Again, the Velcro® surface(s) of the canopy may be permanently attached to the canopy, or may be removably attachable to it).

Thus in the example embodiment, at least one wall is attached via Velcro®. (Such an attachment solution may be provided for any or all of the wall(s)). As stated, Velcro® and/or stitching and/or any other method/way may be used.

(Note, in the example embodiment (or any embodiment(s)), (as shown in some of the Figures), some of the walls may not be attached (either partially or wholly) at their base, to the canopy. For example, looking at the walls (which may also be referred to as 'dividers'), (or some of the walls) of the example outside holding chambers (around the example central holding chamber), one can see that, at their base, they are not attached to the canopy. This is best shown in FIG. 1, where a gap 21 can be seen under one of the walls (and may be present for any or all of the walls/dividers of the example outer holding chambers, (or for any wall(s) at all)). This is also best shown in the close-up of FIG. 7. (Instead, in the example, the example walls/dividers are attached at point 17 (or could be at any other point), and, in the example, this is enough to allow the walls/dividers to do their job. In the example, the gap is relatively small, and in such an embodiment, if a golf ball is hit into one of the example outer holding chambers, the gap is not big enough that the golf ball can go through the gap. Thus the golf ball stays in the holding chamber it lands in. Thus, in the example, the gap(s) do not stop the wall(s) doing their job.

(It should also be stated, even if there is a gap between the or any wall(s) and the canopy, it is feasible the wall(s) may also be attached at various points along the wall and/or gap. This would thus feasibly create a plurality of gaps. For example, if the example wall in the example embodiment of FIG. 1 was also attached to the canopy at example point 23, for example, then there may be slight gaps either side of point 23. Thus there may be a plurality of gaps.

(In general summing up of this possible feature, it could therefore be said that there may be a gap(s) under any of the wall(s), between the wall(s) and the canopy).

Thus the or any of the walls may not be attached, at all points of their base, to the canopy. (It should also be stated that it is feasible/possible the or any of the walls are attached, at all points of their base, to the canopy).

In the example embodiment, (shown most clearly in FIG. 1 and FIG. 5, and shown/provided simply by way of example only), each wall 38 (which may also be referred to as a 'divider') of the outer holding chambers, in the example, comprises an aperture. (Only several of the walls have been numbered, in FIG. 1, in order to retain clarity in the Figure). In the example(s), (provided by way of example), the aperture is provided by way of a grommet hole. (This, (which is a feature and example, provided by way of example only, can be seen towards an outer-most point of each of the example walls 38 of the outer holding chambers). In the example embodiments, there is also an aperture (roughly at point 17, in the example(s)). In the examples, this is provided by way of a feature. The feature may, for example, be a hook, (or any other feature, for example), that comprises an aperture(s). The hook may, for example, be permanently or removably attachable hooked, roughly at point 17. In the example, (provided by way of example), there is then a cord element 40 (several of which are numbered in FIG. 1, for example), which attaches the two apertures (eg the grommet hole of the wall, in the example, and the hook, in the example), and thereby attaches, in the example, the wall roughly to point 17. It will be apparent, however, that this is just one way of forming and/or providing and/or attaching such features, and is provided simply by way of example only. As stated, features may, for example, be stitched, and/or Velcro®-type attachment arrangements may be provided and/or hook attachments and/or clip attachments, (or any arrangement(s)). Thus the example is provided by way of example only, simply showing an example of how an example embodiment of the apparatus may be formed and/or put together.

(The example, (which in the example, comprises a cord element), may be a permanent attachment, or it is feasible, for example, that it may be possible for the user to un-attach the wall from point 17. This may, for example, be possible in various ways, in the example. For example, it may be possible to open the example hook (or any aperture), to release the example cord, and/or it may be possible to undo the cord element, for example. These are just examples, provided by way of example only. (Permanent or detachable solutions may be provided in any embodiment(s), for example)).

(A holding chamber may be formed by virtue or one, or more, wall(s). For example, the outer holding chambers, in the example of FIG. 1, for example, are each defined by three walls/dividers. They have a wall on each side (left and right, in the examples), and a wall at their inner-most side. (The wall at the inner most side also plays a role in defining the central holding chamber, in the example). In the example, the central holding chamber could be said to only have one wall, (which, in the example, goes around the whole of the central holding chamber). That is one interpretation. However, one may equally interpret that it comprises a plurality of walls, because, in the example, each of the differently angled wall (parts), (of which there are eight, in the example, and provided by way of example only), may be interpreted as being different 'walls'. Either interpretation is possible. (It should also be said that the differently angled walls (and/or wall parts—eg eight, in the example, (or any number)) of the central holding chamber could, potentially be made out of the same one piece (of material), or any or all of them (ie the differently angled walls (and/or wall parts)) could feasibly, be different parts/pieces. (They could therefore be different pieces of material). In the example, all the surrounding wall(s) of the central holding chamber are one part (and are one material). It is thought this is less complex, and makes the apparatus easier to manufacture and/or to use).

Preferably the apparatus is an umbrella apparatus. However, it should be stated, the apparatus may, or may not, look like and/or be an umbrella. For example, an embodiment may be provided, for example, with a basic shaft (eg a wooden shaft, for example), and an openable and closable canopy which may, for example, look more like a sun-shade (for example) than a typical umbrella looking apparatus or canopy. Such an embodiment may (spuriously or not) be argued not to be an 'umbrella'. Thus it is stated that the apparatus is preferably an umbrella apparatus, to make it clear that the scope is not limited (especially via use of arguable and/or spurious arguments) to being what would typically be considered to be (and/or look like) an 'umbrella'.

Preferably a portion or a whole of the shaft 12 can be changed in angle. This allows the shaft to be angled substantially upright, when the apparatus 10 is upside down and tilted. This is again clearly seen/shown in FIG. 1. The reason this might be important is that umbrellas tend to tilt when laid upside down. (This may, for example, be due to (or exaggerated by) a feature like a point 41, as shown by way of example in FIG. 2 and/or may simply be the way the/a canopy sits, when upside down). This can actually be useful for the game, because if the umbrella/apparatus is tilted towards the user/player, it is easier to see the features of the apparatus, (including the holding chambers, for example), whereas if the umbrella/apparatus points perfectly upwards (and is not tilted), it may be hard for the user/player, (especially if they are standing at a significant distance from the apparatus), to see the holding chambers and other features.

However, if the apparatus is tilted, then if a flag is at (or towards) an end of the shaft, for example, (as will be discussed), then the shaft and the flag would extend at an angle, also tilted. It is (or may be) desirable if the flag is not tilted. Thus preferably, as stated, a portion or a whole of the shaft 12 can be changed in angle, to allow the shaft to be angled substantially upright, when the apparatus 10 is upside down and tilted.

There are several ways to achieve this. In the example of FIG. 1, for example, the shaft can be (and has been) bent, to change angle of the portion or the whole of the shaft. (It is shown having been bent approximately at point 19, (although it may be bent/bendable anywhere)). In the example, approximately at point 19, (and not visible due to being obscured by the view shown), there is a part of the shaft that is bendable. (In the example, this part may be, for example, 4 cm-6 cm long, but it may be any length). Thus, in the example, via that part being bent, the portion or the whole of the shaft (which, in the example, is a portion, rather than a whole of the shaft) above that part is changed in angle. (This is clearly shown). Whilst, in the example, only a part of the shaft is bendable, it is feasible, of course, that the whole of the shaft is bendable, (or that a part (of the shaft) that is bendable could be provided at a position such that a whole (or almost a whole) of the shaft can be changed in angle). (Thus when the term 'the shaft can be bent' (to change angle of the portion or the whole of the shaft), it includes within its scope a part of the shaft being bendable, or a whole of the shaft being bendable)). (It will be apparent that standard shafts of umbrellas (and many materials) cannot be bent into a new shape in this way, but instead return to their original position once bent, (or snap, if bent too far)). What is shown is thus an example of wherein a part or a whole of the shaft is of a material(s) such that the shaft can be bent, to change angle of a portion or a whole of the shaft.

Thus, in the example embodiment, the angle of the portion or the whole of the shaft can be changed. Thus, in the example of FIG. 1, the umbrella/apparatus is tilted, but the portion or the whole of the shaft (and the flag) nevertheless extend substantially straight, upwardly.

Thus preferably the shaft can be bent, to change angle of a portion or a whole of the shaft.

However, there are other ways to achieve this. For example, it is feasible the shaft comprises a hinge, to facilitate changing angle of the portion or the whole of the shaft. (Thus there could be a hinge, for example, at point 19 (or anywhere), so that the portion or the whole of the shaft could be changed in angle at the hinge. Thus the same (or substantially the same) effect as shown in FIG. 1, could be achieved, with the shaft comprising a hinge. (In the example, if the hinge was located at example point 19, it would be an example wherein a portion (not a whole) of the shaft could be changed in angle via the hinge. (However, it is feasible a hinge could be provided (and at a position), to change angle of the whole of the shaft)).

Preferably the apparatus comprises a flag 22. (An example of this is clearly shown in FIG. 1). In the example(s), shown most clearly in FIGS. 1, and 5, where the apparatus is shown in use, there is provided an example flag 22, for the shaft 12. The flag, in the example of FIG. 1, is shown attached to (or towards) an end 24 of the shaft 12. Whilst it is feasible the flag is permanently attached (which may or may not include it being formed as part of a portion or a whole of the shaft), more preferably, it is preferably removably attachable. In the example of FIG. 1, the example flag 24 is removably attachable to the shaft. In the example, the apparatus (and the shaft) comprises a handle 25. In the example, the flag 22 is attached to the handle (and thus to the shaft). In the example, the flag 22 is attached to the end of the handle (and thus, in the example, to the end of the shaft). However, it is feasible the flag may be attached (preferably removably) close to the end of the shaft, but not right at the end of the shaft). Thus the term attached 'to or towards' the end of the shaft is used, to include this within its scope. In the example of FIG. 1, there is a hole (thus there is an aperture) at the end of the handle (and thus, in the example, at the end of the shaft). In the example embodiment, an example stem 27 is then put into the aperture. Preferably the stem fits tightly into the aperture, (and/or is attached in any way). In the example, the stem can also be removed. Thus, in the example, the flag is removably attachable. (The flag need not comprise a stem, and other embodiments may be provided, for example, where the fabric part of the flag alone is provided (without any stem), and the fabric part of the flag may then be attached and/or attachable (eg removably attachable) to the shaft, without need of a stem.

As stated, preferably the flag 22 is removably attachable.

Preferably the apparatus comprises a cup element 26. Preferably the cup element surrounds the shaft 12. This is clearly shown in FIG. 1. In the example, the cup element is provided by way of a funnel-type element. However, the cup element, (it will be apparent), may come in various different shapes and sizes, nevertheless being within the scope of being a cup element. (The function of the cup element will become more clear when the apparatus is described, in use).

(It should be noted that, whilst the cup element preferably surrounds the shaft (as shown), it is feasible a cup element may be provided, not limited to having to surround the shaft. For example, a cup element may be provided, which may, for example, be able to be clipped onto (or attached in any way to) the shaft, (and, it should be said, a cup element is not limited to being attached to the shaft, and may be attached to any other feature(s)/place, (eg spoke(s)/strut(s), or any other feature(s)/place of the apparatus)). (And, it should also be said, a cup element may be provided, and may be placed and/or positioned at any point(s) (ie at any place) and/or in any way, (not limited to being 'attached'), and may thus be provided anywhere about the apparatus)). This is just one example, and other examples of a cup element that does not surround the shaft are possible, which will be apparent, (not limited to clipping, for example). However, there are various benefits to the cup element surrounding the shaft. One benefit, for example, is that it makes the apparatus look more like a golf hole and pin. (ie The shaft and the cup element highly resemble how a pin (on a golf course) goes into a golf hole). Another benefit is that the cup element may be less breakable. Another benefit is that embodiments where the cup element does not go around the shaft may be more susceptible to the cup element getting lost.

Figure 2:
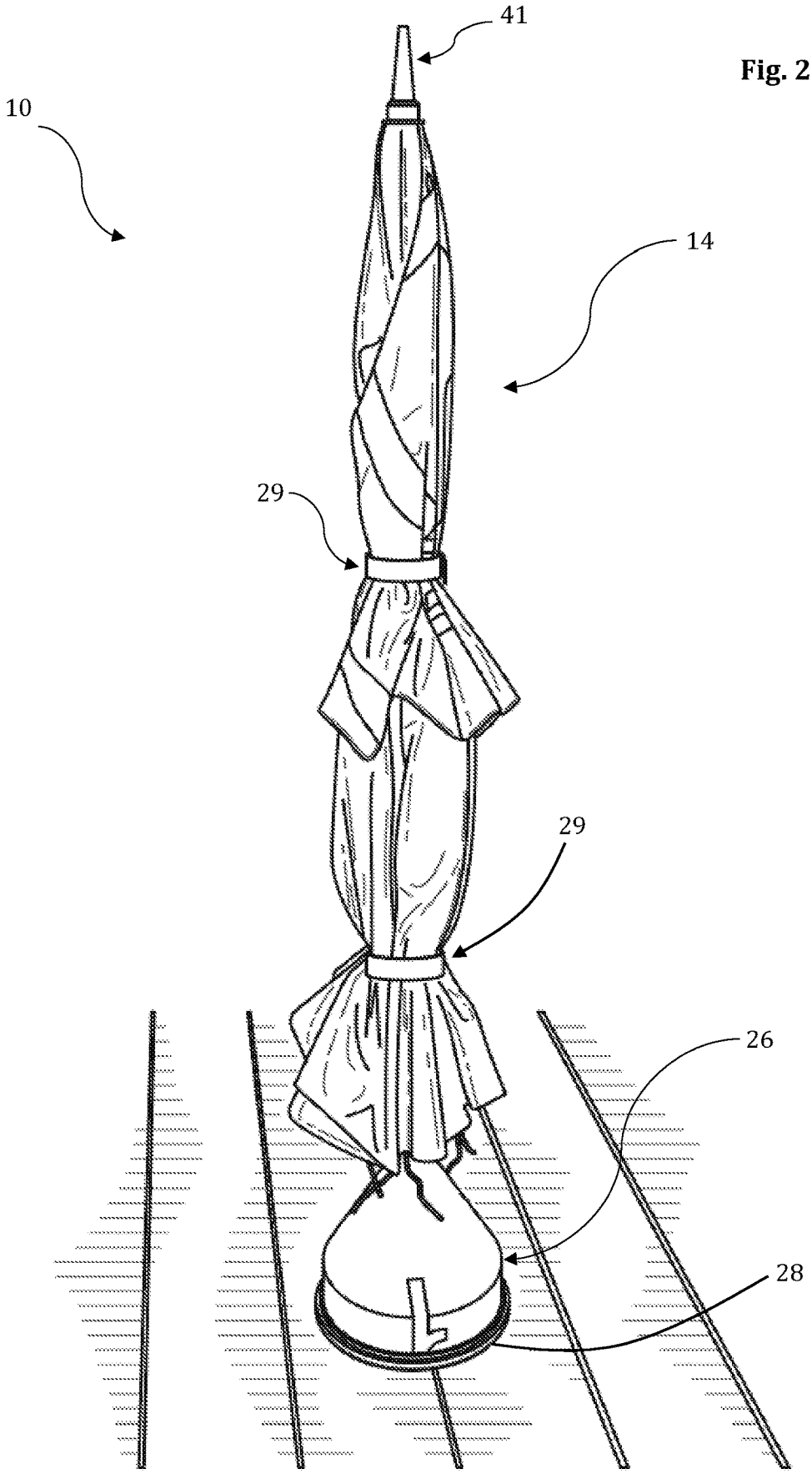
FIG. 2 is a perspective view of a same or similar embodiment as shown in FIG. 1, now shown standing upright, with the canopy closed.

Preferably the cup element 26 is movable up and down the shaft 12. This is clearly shown, in the example(s), by virtue of the difference in position of the cup element in FIG. 1, and then in FIG. 2 and FIG. 3. In FIG. 1, the cup element is shown in a position. The position is high on the shaft (which seems low, from the view shown, with the apparatus upside down). In FIG. 2, however, the cup element is shown in a different position. It is now shown in a low position on the shaft. In FIG. 2, the apparatus is shown standing upright. In FIG. 2, the canopy is shown closed. (Whilst the cup element is shown being movable up and down the shaft in an embodiment where the cup element surrounds the shaft, it is feasible a cup element, even which does not surround the shaft, (eg an embodiment wherein the cup element is clipped to the shaft (or attached via any other attachment mechanism/means and/or in any other way), for example), may be movable up and down the shaft. For example, the clipping attachment mechanism may allow for the cup element to move up and down the shaft. However, it is thought being movable up and down the shaft, in embodiment where the cup element surround the shaft, may be particularly beneficial.

(Feature(s) may be provided, (not uncommon in, and/or same/similar to often provided with, umbrellas, for example), such as clip(s), strap(s), etc, (or any closing mechanism), to keep the canopy closed, if desired. Such feature(s) are often provided with umbrella apparatuses, and may be provided with any embodiment of the present apparatus. In the example, there are two closing mechanisms 29. There may be any amount of closing mechanisms, (ie one or more). In the example, each closing mechanism comprises a strap (or any feature), which goes around the canopy, to help keep it shut. (A strap is an example of a cord element, but any feature(s)/arrangement may be provided). Such mechanisms often comprise Velcro®, or buttons, for example, to keep the canopy kept shut).

Thus the cup element is preferably movable up and down the shaft 12. In the example, the cup element is slidable up and down the shaft, and has slid from one position, to another.

Figure 4:
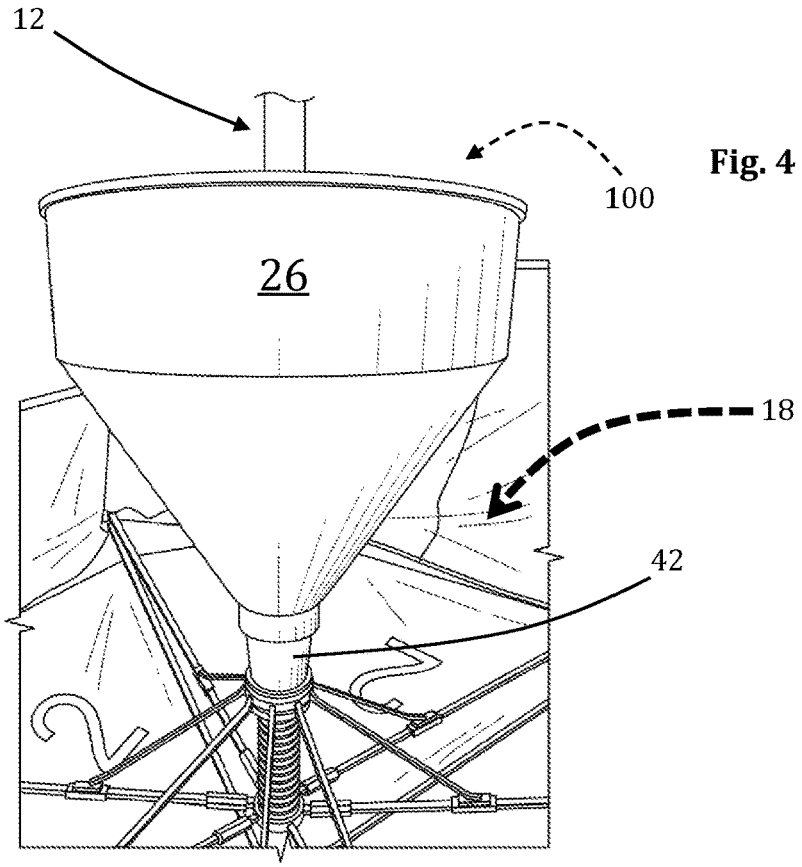
FIG. 4 is a close-up perspective view of an example embodiment of the cup element.

Preferably the apparatus is configured so that the cup element naturally goes up and down the shaft, when the canopy is opened and closed. (This may be the case for any embodiment of a cup element. However, it is thought this feature may be most useful/beneficial for embodiments wherein the cup element surrounds the shaft). Preferably the apparatus is configured so that the cup element naturally moves to a high position on the shaft when the canopy is opened. Preferably the apparatus is configured so that the cup element naturally moves to a low position on the shaft when the canopy is closed. In the example, this is achieved by the cup element being secured. This is best shown in FIG. 4, where the cup element is shown, close up. In the example, the cup element comprises an aperture (not visible in the view shown), and the cup element (via the aperture) is tightly fitted onto portion 42. It can be seen that the fit, onto the example portion 42, in the example, is tight. This secures the cup element, in the example, to the example portion 42. The portion example 42 is able to slide up and down the shaft. Thus the cup element slides up and down the shaft, with the example portion 42. In the example, the portion slides up and down the shaft (automatically) as the canopy is opened and closed. Thus, in the example, the cup element automatically slides up the shaft, (when the canopy is opened), and down the shaft (when the canopy is closed). (In the example, the shaft 12 of the apparatus goes through the example portion 42, and the example portion is able to move up and down the shaft). (Thus this is an example of the cup element being secured to a feature that is able to slide up and down the shaft. What is shown is an example of the cup element being secured to a feature(s) that slides up and down the shaft automatically as the canopy is opened and closed, (and thus facilitates the cup element in sliding up and down the shaft automatically as the canopy is opened and closed). In the example, the feature is example portion 42, provided by way of example only. The cup element may, in other embodiments, be secured to any other feature(s), (and/or in any other way), that facilitate it in sliding up and down the shaft automatically when the canopy is opened and closed. (And it should also be said, so the same is the case for any embodiment of a cup element, whether it surrounds the shaft, or not. Thus a cup element, (whether it surrounds the shaft, or not), may be secured to any feature(s) that facilitate it in sliding up and down the shaft automatically when the canopy is opened and closed, (eg spoke(s)/strut(s), for example), not limited to example feature 42)).

(In the example, the cup element is a funnel-type shape, and funnels down towards the aperture which is seen surrounding the example portion 42, (and onto which it tightly fits, in the example), but as has been mentioned, the cup element may be various other shapes and/or sizes, and the example is provided by way of example only).

(It will be apparent that a similar, or same, solution could be used, to facilitate the cup element automatically sliding up the shaft, (when the canopy is opened), and down the shaft (when the canopy is closed), even in embodiments when the cup element does not surround the shaft, (eg where it is clipped to the shaft, for example). (For example, if a cup element that does not surround the shaft was clipped, for example, (or attached in any way), to example feature 42, it would, in the example, thus facilitate the cup element in automatically sliding up the shaft, (when the canopy is opened), and down the shaft (when the canopy is closed). Nevertheless, as stated several times, embodiments wherein the cup element surrounds the shaft are particularly preferred).

(It should also be said, it is feasible (either in combination with such feature(s), or without them, that the cup element may be secured in other ways. For example, the cup element may be glued, or secured in any other way. It may be attached in any way, for example, which would be an example of it being secured).

(It should also be said that, whilst it is preferable the cup element is secured, it is also feasible embodiments may be provided where the cup element can freely slide up and down the shaft, without being secured to a given point).

Preferably the cup element 26 is movable to or towards the end 24 of the shaft 12, and, with the canopy closed, is able to form a base, to facilitate standing the apparatus upright. (This is clearly shown in FIG. 2, especially, where the cup element is now forming a base, which is allowing the apparatus to stand upright).

Figure 3:
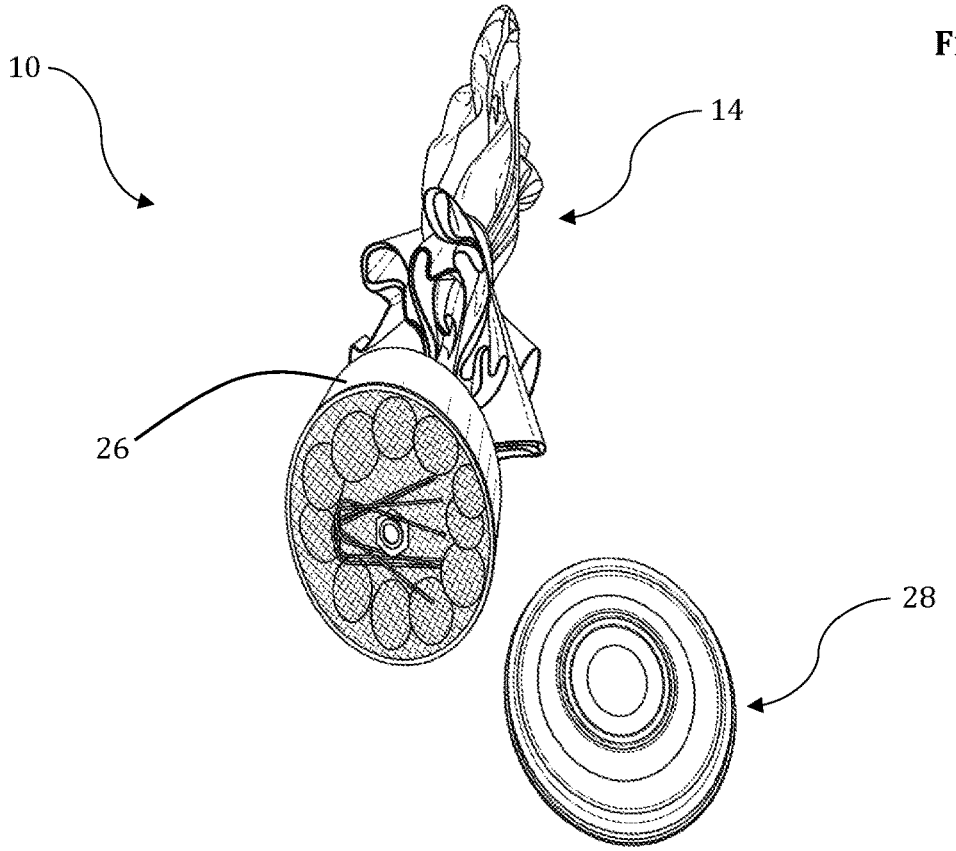
FIG. 3 shows a same or similar embodiment to that as shown in FIG. 2, now showing the apparatus lying on the ground, and showing golf accessories stored in a cup element and/or base of the apparatus.
Figure 5:
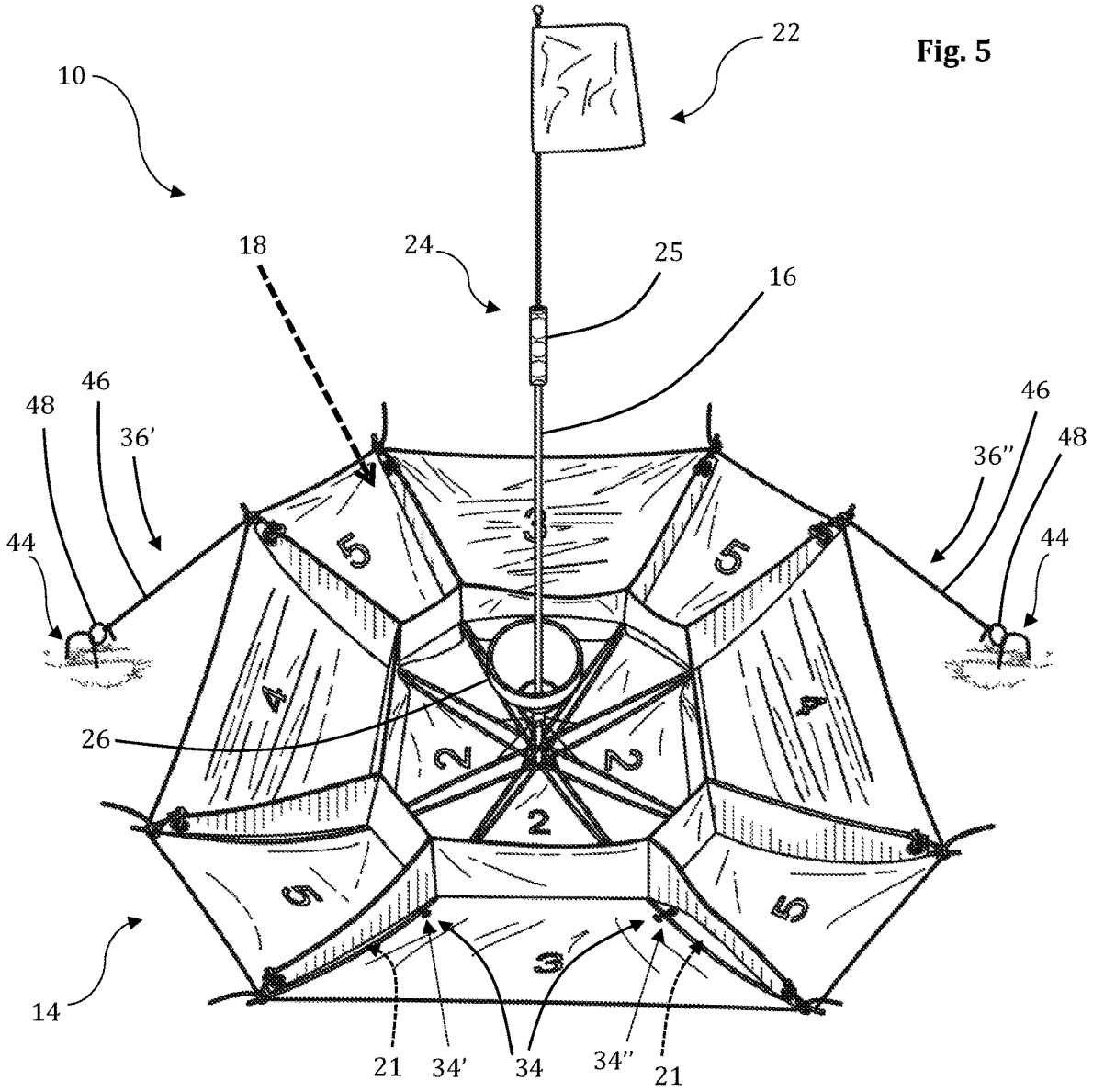
FIG. 5 is a perspective view of an example embodiment of the apparatus, with particular reference to potential features of an example embodiment of a pinning arrangement, for pinning the canopy to a ground.

(It should also be stated that various feature(s) and/or arrangement(s) may be provided, to keep the canopy open and/or to keep the canopy closed. For example, umbrellas tend to have mechanism(s) to do this. For example, there is often a spring-loadedly protruding feature (one towards the top and/or one towards a lower end of the shaft). It will be know to umbrella users that the canopy (usually with a spoke mechanism, for example, can be closed, at which point the mechanism, in such embodiments, can go over (and depress) a protruding feature (which tends to be spring-loaded). Once the mechanism is past the protruding feature, it tends to spring-loadedly protrude again, thus acting as a stopping mechanism, to now keep the canopy closed. The user can then, (often manually), depress the protruding feature, to thus allow the canopy to again be opened. So a similar feature(s)/arrangement may be provided higher up the shaft, to do a same or similar thing, regarding keeping the canopy open. Such feature(s)/arrangement(s), (not limited to such an example), may be provided (and are preferably provided) for the apparatus. Thus, when the cup element is in the low position (as shown in FIGS. 2 and 3, for example, there may be a mechanism that 'stops' or 'traps' it in that position. Similarly, there may be a mechanism that 'stops' or 'traps' the cup element (and/or any other feature(s)) in the high position, (eg as shown in FIG. 1 and FIG. 5, (when the canopy is open)). Thus, broadly speaking, there may be provided (and preferably is provided) a mechanism to keep the canopy open. Thus, broadly speaking, there may be provided (and preferably is provided) a mechanism to keep the canopy closed.

Preferably the apparatus comprises a lid 28 for the cup element 26. (An example lid 28 is shown in FIG. 2 and FIG. 3). (The example shows an example wherein there is a lid, for a cup element that surrounds the shaft. However, a lid may be provided for any embodiment of a cup element, not limited to being for cup elements that surround the shaft).

Preferably the lid 28 for the cup element 26 is removable. (An example of this is shown in FIG. 3, where the example lid is shown removed).

(It is feasible embodiments may be provided where a lid is provided, and the lid stays attached permanently to the cup element (eg via being hinged to the cup element, or via any other means/way). However, this may not be ideal whilst the apparatus is in use. Thus preferably, the lid is removable.

Figure 8:
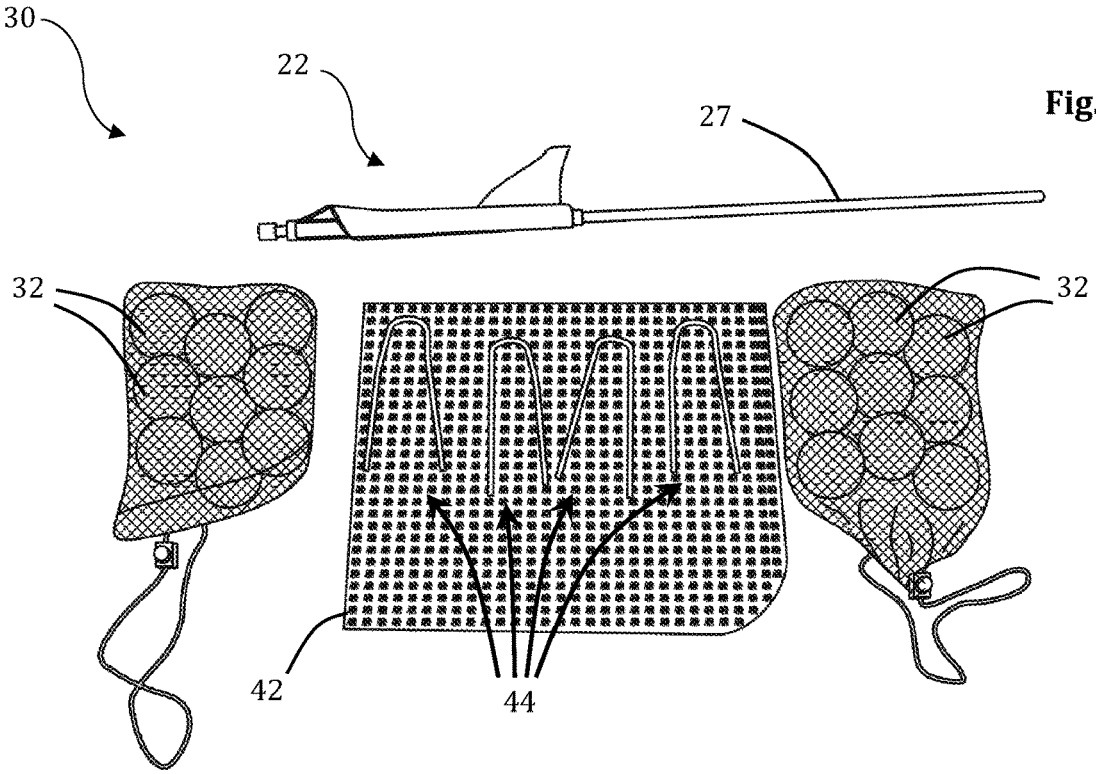
FIG. 8 shows an assortment of possible accessories.

There may be provided accessory(s) 30, (preferably golf accessory(s)). For example, golf ball(s) (or any form of projectile(s) (and/or ball(s)), for use with the apparatus/game), may be provided with the apparatus. These may, of course, be used as part of the game. It may be possible to store such accessory(s) in the cup element. Thus, optionally, the apparatus further comprises an accessory or accessories (preferably golf accessory or accessories) stored in the cup element. This is best shown in FIG. 3, where the lid has been removed, and accessories (including a plurality of golf balls, in the example) can be seen, stored in the cup element. (Thus preferably the golf accessory or accessories comprises a plurality of golf balls 32. (It is feasible just one golf ball is provided, although preferably more than one (ie a plurality) is provided). A plurality of accessories are shown, by way of example only, in FIG. 8. In the example, these include golf balls 32. (Only several are numbered, but many are shown). There may be (as shown), container(s), (eg bag(s)), to hold the golf balls. (The golf balls are shown in two bags, in the example, but any amount of container(s), (ie one or more) may, or may not, be provided). Each example bag (which is an embodiment of a container) comprises a handle, (which, in the example, is provided by way of (and thus comprises) a cord element, but may be provided in any way, not limited to the example(s)). There is also shown an example flag 22. There is also shown an example chipping mat 42. Thus this may be used for the user/player to chip a golf ball from, to try to get it into the apparatus. There is also shown, in FIG. 6, example pinning elements 44. In the example, there are four pinning elements. (However, there may be any number—ie one or more). Thus pinning element(s) may be provided. Their use will become apparent and will be explained.

The term 'golf balls' here includes within its scope both regular golf ball(s) (ie for use by golfers, when they play a round of golf, for example), and also what are often referred to (in the game of golf) as lightweight 'practice' balls, which tend to be golf balls of much more lightweight material and weight. With reference to providing golf ball(s), regular golf balls and/or practice golf ball(s) (and any combination of the two) may be provided. If differentiation is needed between the two, the terms 'regular' (or 'normal', or 'standard') golf ball(s) may be used for regular golf balls, and the term 'lightweight practice' golf ball(s) may be used for lightweight practice golf balls. (Preferably regular golf ball(s) are used/provided with the apparatus, since that would be the best practice for the user by best replicating real golfing conditions and equipment). It should also be stated that, use of regular golf balls could, feasibly, make it more likely that the apparatus (eg the holding chambers, or any other part of the apparatus) could become damaged by being hit with the regular balls (ie because of their hardness and/or weight). Thus lightweight 'practice' ball(s) may be useful. Lightweight practice ball(s) may also be useful for young children using the apparatus and/or playing the game.

In some cases, with accessories like golf ball(s) (and the chipping mat, for example), if such accessory(s) are provided, language may be used, stating that there is provided a 'kit of parts', (comprising the apparatus; and the accessory(s)). However, language simply stating that 'there is provided' (the accessory(s)) may be used, or words to that effect, (rather than use of the term 'kit of parts'). For example, if at least one golf ball is provided, language may be used, stating that 'a kit of parts' is provided, (comprising the apparatus; and at least one golf ball). Alternatively, language simply stating that the apparatus is provided, and that there is provided 'at least one golf ball' may be used, (instead of using the term 'kit of parts').

(It should be noted, it has been mentioned earlier how the apparatus preferably comprise a closing mechanism(s) 29, for keeping the canopy kept shut. (Best shown, by way of example only, in FIG. 2). It should be noted, it is possible the chipping mat 44 may itself be used as (and/or as part of) a closing mechanism. For example, if the chipping mat has attachment features (such as Velcro®-type attachment feature(s), for example, (and/or any other(s), eg one or more straps)), then it is feasible it could be wrapped around the canopy, and enclose around it, to keep the canopy closed, (using the attachment feature(s)). (This could be used as a closing mechanism in and of itself (ie not requiring further closing mechanism(s), such as the example closing mechanism(s) shown in the example embodiment of FIG. 2, for example). However, it should also be said it may be provided, in combination with (ie with) other closing mechanism(s)—thus it is feasible, in the example embodiment of FIG. 2, for example, that the strap(s) may be provided (as a closing mechanism(s)), (and/or any other closing mechanism(s)), and that the chipping mat may also comprise a closing mechanism(s)). However, it should also be said that it is possible that the chipping mat will simply be stored inside the canopy area, when the canopy is shut. (It is also possible, as stated, that it may be possible to store the mat inside the cup element).

There may be provided embodiments where the flag can be stored in the cup element. (This may be more possible/likely in embodiment where the flag does not comprise a stem (or comprises a very small stem (or any suitable attachment means), to attach to the shaft)). It should also be stated that it is feasible the flag may be provided as an assembly, where a portion or a whole of the stem breaks off/away from the flag. One (or both, or all) parts may then be storable in the cup element. (It should also be stated that, even in such embodiments, one, or both or all, parts may be stored in the canopy area, when the canopy is closed. Thus, broadly speaking, any accessories/elements may feasibly be stored in the cup element, or may be stored in the canopy, when the canopy is closed. (Obviously, if a suitable closing mechanism(s) is provided, this will help keep any elements held inside the canopy, when the canopy is closed, hopefully preventing them from falling out).

(It should also be stated that it is feasible the flag could telescope into the handle (or any part of the shaft) of the apparatus. (The or any stem, or flag, (or both) could telescope into the handle (or any part of the shaft). Thus it is feasible there could be some sort of telescopic mechanism, (feasibly), to contain the flag and/or stem of the flag).

In the example, the apparatus comprises a substantially rectangular canopy. However, the canopy may be any shape, including, for example, a more traditional more rounded shape, (which are more tradition for umbrella apparatuses, for example).

Preferably there is provided a pinning arrangement, for pinning the canopy to a ground. (This is best shown in FIG. 5). This can be useful in making sure the apparatus stays in position, when it is being used. (This may be particularly useful in windy conditions, for example).

Preferably the pinning arrangement comprises a back pinning arrangement, for pinning a back of the canopy to the ground. (This is best shown in FIG. 5). In FIG. 5, the example back pinning arrangement comprises a first arrangement 36', and a further arrangement 36". Together, they form a back pinning arrangement. (Thus this is an example of an example back pinning arrangement comprising a plurality of arrangements, for pinning). (However, it should be said, a back pinning arrangement need not comprise more than one arrangement, and may, for example, comprise only one arrangement. Furthermore, there could be more than two arrangements). In the example, each of the arrangements 36 comprises a pinning element 44. The pinning elements, in FIG. 5, are shown pinned into the ground, thus pinning the canopy to the ground. (In the example, the pinning element(s) are separate elements that come separately from the rest of the arrangement. However, it should be stated that it is feasible embodiments may be provided (for any pinning arrangement(s) in the present application), where a pinning element(s) is permanently attached (and/or formed) as part of the or a pinning arrangement. Therefore embodiments may be provided where the or any pinning element does not some in such a separate form (ie so separate to the rest of the apparatus), as shown in the example embodiments if the drawings. However, as shown, preferably the (or any of the) pinning element(s) do come as separate element(s) to the rest of the apparatus).

In the example, (provided by way of example only), each of the arrangements 36 comprises a feature 46. In the examples, (provided by way of example only), the feature 46 is elongate. In the example, (provided by way of example only), the feature 46 is a cord element. In the example, the feature may be string, for example. In the example, (provided by way of example only), there is an aperture feature 48. This, in the example, attaches feature 46 to the pin element 44. However, it will be apparent there are many ways in which such an arrangement (or any suitable/relevant arrangement) may be provided, not limited to the feature(s) as shown in the example embodiments, which are provided by way of example only.

Figure 6:
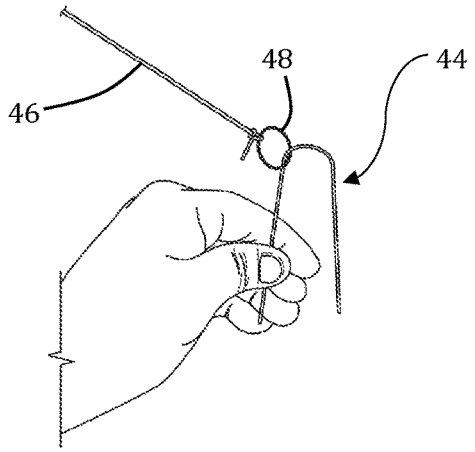
FIG. 6 is a close-up view showing a user in process of using an example pinning element, to pin the canopy to the ground.

(An example of an example pinning element 44, in process of being pinned into the ground, is shown in FIG. 6, in close-up).

(In the example, example feature(s) 46 is/are attached/connected to the canopy, generally at point 17, (although they may be attached/connected at any point). They may be attached/connected in any way, (not limited to the examples shown), and may even be formed as part of a portion or a whole of the canopy, or any other feature. It is feasible they are stitched to the canopy. In the examples, they are attached via an aperture, (which, in the example, is generally located at point 17, but may be at any point/location)). (In the example, they are tied through the example aperture (generally at point 17). However, as stated, this is provided by way of example only.]

Preferably the pinning arrangement comprises a front pinning arrangement 34, for pinning a front of the canopy to the ground. An example of this is shown from a distance, in FIG. 5. In the example, the front pinning arrangement comprises a first arrangement 34' and a further arrangement 34". (Although, similarly to the or any back pinning arrangement, the front pinning arrangement may comprise one arrangement, or any number of arrangements (including more than two, for example), for pinning).

Figure 7:
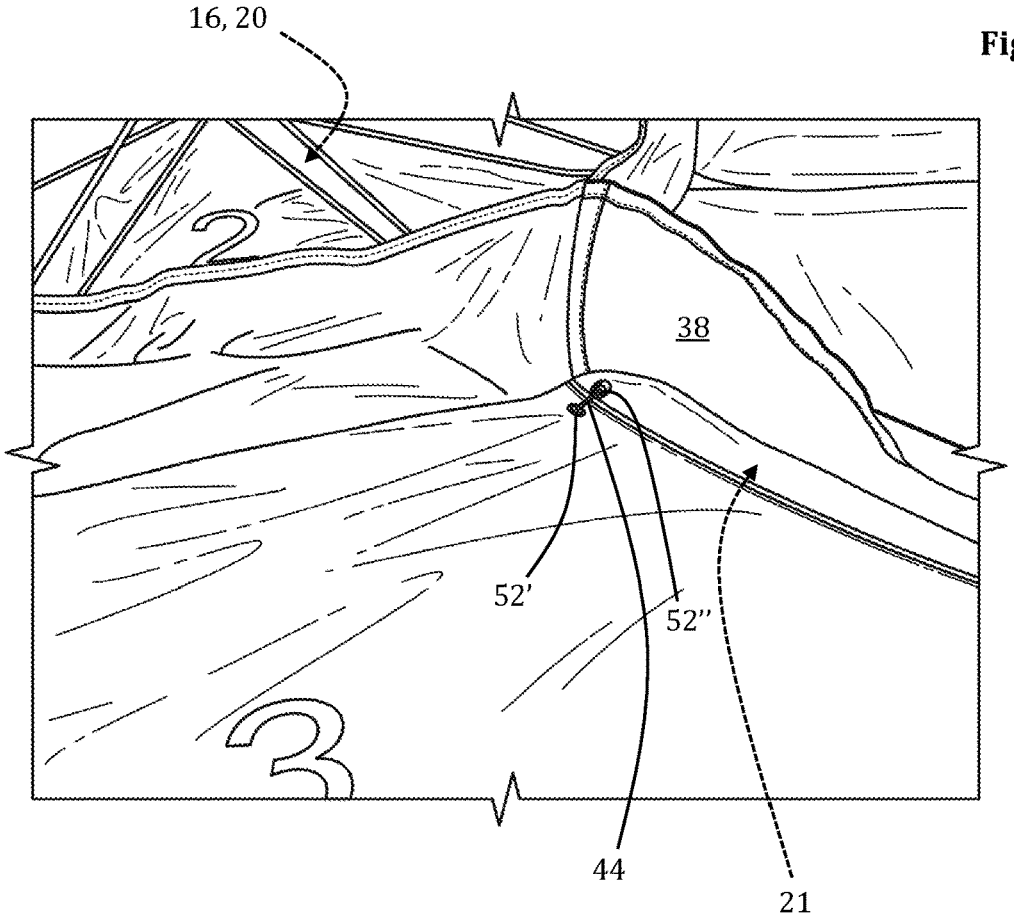
FIG. 7 is a close-up perspective view of example features relating to an example front pinning arrangement.

One of the example arrangements of the example front pinning arrangement is then shown, close-up, in FIG. 7. In FIG. 7, it can be seen that the example arrangement comprises a pinning element 44. (Much of this is not visible, but the top part of the pinning element is visible, and numbered). In the example, the arrangement also comprises two apertures 52. (They are numbered 52' and 52"). (In the example, provided by way of example only, the example apertures are grommet holes).

Therefore, in the example, the pinning element goes through both apertures, and is pinned into the ground, thus pinning the canopy to the ground. In the example, the pinning element(s) (as clearly shown, by way of example, in FIG. 8) are double sided pinning elements. In the example shown in FIG. 7, there are two apertures 52, with one side of the pinning element going through one of the apertures, and another side of the pinning element going through the other aperture. However, it should be said that it is not required that the or any pinning element be a double-sided pinning element (in the front, back, or any pinning arrangement), and a single version pinning element may be used. It should also be stated that there may be only one aperture 52 (rather than a plurality (ie two or more)). For example, a pinning element may be used which is not double-sided, and which, for example, comprising an elongate pinning portion, and a broad head. In such a case, it is feasible the arrangement (eg of FIG. 7) may only comprise one aperture 52 for the (or each) pinning element. The elongate portion of the pinning element may then go through the aperture, and, if the head of the pinning element is larger than the aperture 52, the pinning element could be successfully used, with there only being one aperture 52. (It should also be said that a plurality of pinning elements may be used in this way, in which case there may be a plurality of apertures 52, with one for each pinning element, for example). However, in the example, clearly shown in FIG. 7, the arrangement comprises a double-sided pinning element, and two apertures 52 for the pinning element. In the example, the pinning element is pinned either side of a rib of the canopy (not easily shown/visible, but it is clear the pinning element is pinned either side of a line, which suggests where the/that example rib of the canopy element is. (The rib may be provided by way of a spoke). This can be even more helpful in pinning down the canopy. This can also make it less likely that the canopy will be damaged by pinning.

(A singular-type pinning element, it should be said, could also feasibly be usable for the back pinning arrangement. For example, in FIG. 6, a singular-type pinning element could go through the example feature/aperture 48, in the example. If it had a head that was bigger than the aperture of feature 48, then it will be apparent it would potentially be usable for pinning. Generally speaking, it should be stated that the pinning elements shown are shown by way of example, and pinning element(s) of a wide variety of shapes, sizes and designs may be used/provided).

It will be clear that the example front pinning arrangement shown comprises aperture(s) in the canopy. These could make the apparatus less usable as an umbrella, for example, as rain could feasibly travel through such aperture(s), and therefore through the canopy. It should also be stated that the example back pinning arrangement shown does not include any apertures in the canopy that would lead to such a problem.

It should be stated that the front arrangement could, feasibly, be provided without any aperture(s) in the canopy, (eg it could be provided in a same or similar way to the example back pinning arrangement, for example, thus without aperture(s) in the canopy itself). (In such an embodiment, it may or may not require example feature(s) 46, because the pinning element(s) may, feasibly, go directly into the ground). Similarly, the back pinning arrangement could, feasibly, be provided similarly or the same to the front pinning arrangement, and may therefore comprises aperture(s) in the canopy. In such an embodiment, pinning element(s) may go through the aperture(s), or, perhaps, other feature(s), (eg example feature(s) 46) may go through the aperture(s), and lead to a pinning element(s). (This, (ie a back pinning arrangement being provided same or similarly to the example front pinning arrangement (and especially pinning element(s) going through an aperture(s) in the canopy)) may be a bit unwieldy and challenging, but nevertheless is technically possible). Thus the examples are shown by way of example only, and many different ways and embodiments may be provided, to facilitate pinning. (And, to make clear, any feature(s) shown with reference to the example back pinning arrangement may be used for the front pinning arrangement, and vice versa. The examples are provided by way of example only. (And any feature(s) shown with reference to the example back pinning arrangement and/or example front pinning arrangement may be used for any pinning arrangement, not limited to being a 'back' or 'front' pinning arrangement)).

(It should also be stated that either or both of a front pinning and back pinning arrangement may be provided. (preferably, as shown, both are provided). It should also be stated that a pinning arrangement (for pinning the canopy to the ground), is not limited to having to comprise either (or both) of a front pinning arrangement and a back pinning arrangement. For example, pinning arrangements may be provided that pin a side(s) of the apparatus down, and are therefore not clearly a back (or a front) pinning arrangement. Nevertheless, these would nevertheless clearly fall within the scope of being a pinning arrangement (for pinning the canopy to the ground).

(The 'ground' will tend to be soil, with grass/lawn, etc, as denoted in basic artistic fashion by the ground where the pinning elements are pinned into the ground, in FIG. 7, but could be any area. Users may use the apparatus on a beach, for example).

(Dashed lines in the drawings may be used, at various points, to denote places where stitching may occur. This is most clearly visible in FIG. 7).

(The apparatus may comprise various spoke(s)/strut(s). This is perhaps best shown in FIG. 4, (and also in FIG. 1 and FIG. 5). These types of spokes are not uncommon for umbrella-type apparatuses. However, these are provided simply by way of example only), and the apparatus is not limited to such embodiments and features. For example, any structural features may be provided. For example, a basic embodiment may be provided, with wooden (or any type of material) struts, which facilitate opening and closing of the canopy in a basic and standard way, and not limited to the more complex spoke arrangement(s) shown in the example. The examples shown are shown by way of example only. Any openable and closable canopy may be provided, for example).

It should be noted, it is not required that the apparatus is usable, as an umbrella, (ie to use, to shield them from rain, as a normal umbrella is used for). It will be apparent that some feature(s) have been disclosed in the present application that may make it hard to use the apparatus as an umbrella (ie to shield from rain), or may even, feasibly, make it unsuitable for such a use. For example, the concept of having aperture(s) in the canopy (shown in the example embodiment of a front pinning arrangement, in the example of FIG. 7) may lead to rain coming through the canopy, if used as an umbrella, to shield from rain. Furthermore, features relating to the cup element, (for example, the cup element having a lid and/or having item(s) stored in it) may make it hard, or cumbersome, to use the apparatus as an umbrella. Similarly, if item(s) are stored within the canopy (when the canopy is closed), this may again make it cumbersome to use the apparatus as an umbrella, and may lead to the item(s) having to be set aside, in order to do this. Thus it is possible the user will not use the apparatus as an umbrella (ie to shield from rain). However, it should also be said that the apparatus may be used to shield from rain, (ie like an umbrella).

(Furthermore, a portion or a whole of the canopy may, feasibly, for example, be made out of mesh material. Such an example, it if was meshed, and therefore had a vast array of apertures (ie holes, here) in the mesh, would, of course, be little or no use at all for use as an umbrella, to keep the rain off of someone. However, it will be clear that such an embodiment may, nevertheless, (of course), be of use (and functionally effective), as a golf chipping practice game (and/or for other reasons/functions). Thus such embodiments may be provided, which are of little (or feasibly no realistic) use as an umbrella for keeping rain off of a person/user. Thus it should be said that the material(s) and/or structure of the canopy may, or may not, be suitable for use as an umbrella (ie to shield from rain)).

Thus, the apparatus may, or may not, be suitable for use as an umbrella, (ie to shield from rain).

Referring to the cup element, it should also be stated, the cup element may be made of various different types of material(s). In the example, (best shown in FIG. 4), the cup element is solid. However, the or any cup element does not need to be wholly solid. For example, (looking at FIG. 4 as an example), the cup element could have a rim at its top (similar or same to the example of FIG. 4), and the rest (or some) of it could then be netting, for example, (or any non-solid/soft material(s)), (that a projectile (eg golf ball) can be held in, for example). There could then be a portion(s), (eg a spoke(s)/strut(s), for example), going from the rim, and attached, for example, to example feature 42, (or any other place(s)/position(s)). This would nevertheless be an example of a cup element. (Thus, it is shown, by way of example only, that the cup element may comprise a combination of soft and hard material(s), not limited to the example provided). However, preferably the cup element is mostly or wholly solid. (The example is provided by way of example only, simply to show that various embodiments of a cup element may be provided, not limited to being wholly solid, (and where some of the cup element (not limited to the example given) may be of non-solid/soft material(s)).

Furthermore, a cup element has been disclosed in the present application, (which may surround the shaft). However, it should be noted, the or any cup element is an example of an element comprising a top opening 100, to aim into. (The example top opening 100 of the example cup element is labelled in FIG. 4, (although it is not visible from the view shown in FIG. 4 and thus a dashed line is used to number it)). (The example top opening of the example cup element is most clearly visible in FIG. 1 and FIG. 5). However, an element comprising a top opening, to aim into, is not limited to being a cup element. For example, a bag element(s) may be provided. A bag comprises a top opening, (which can be aimed into), and could be attached and/or placed/positioned (and therefore provided) anywhere about the apparatus. (It could be attached to the shaft, for example). There could be provided structure(s) (and/or any feature(s)) to keep the top opening of the bag element(s) open. For example, there could be provided strut(s)/spoke(s), for example, or the like, (or any feature(s)), to keep the top opening of the bag element open. These feature(s) could be attached to the shaft, for example, (or provided (and/or attached) anywhere). If the user successfully hits a golf ball, for example, into the or any bag element, the bag element would then hold the golf ball. A bag element may be made of any material(s). It could, for example, comprise netting, (or any material(s) with hole(s) in it, for example, (of which netting is an example)), or could, for example, not have any holes in it.

Thus a bag element (as well as the example cup element disclosed in the present application) would be an example of a holding element, (to hold a projectile, such as a golf ball(s), for example).

In another example of an element comprising a top opening, to aim into, (and not limited to being a cup element (and not limited to being a holding element), there could be provided an element, for example, that comprises a rim, for example, and then comprises netting, for example, (taken simply by way of example only), descending from the rim, and could feasibly be open at its bottom, (and thus could allow the or any projectile through it). Thus the element may feasibly be open at its bottom, (and/or comprise an opening(s) through which a projectile could travel), and thus could allow the or any projectile through it. Broadly put, the element, rather than holding the projectile (eg golf ball), may allow it to travel through. ('Netting' is just given as an example here, and is an example of soft material. Such an embodiment may comprise/employ any soft material(s), (whether or not it has hole(s) in it). (Thus such an example, (taken by way of example only), could resemble a miniature basketball net, for example). Thus it could be open, and may not hold the projectile (eg golf ball) that goes into it. (There could then be a tray, or container, (or any area), below the element, for example, into which the golf ball(s), for example, (or any projectile), could go, once it has gone through the element). (Thus it may, for example, then be held in a tray, or container, (or any area), below the element). This example (eg of a miniature basketball type element) would also, therefore, (like a basketball net, for example), be an example of an element that comprises a top opening, to aim into, (even though it may not hold the projectile(s), (eg golf ball(s), for example), that goes into it). (It should also be stated that the example of comprising netting (or any soft material(s), for example), is provided by way of example only, and the element may, for example, be mostly or wholly solid, (and yet could still be open at its bottom, (and/or comprise an opening(s) through which a projectile could travel), in such a way that allows a projectile (such as a golf ball) to go through it).

Thus an opening may be provided, into which to aim, and the projectile (eg golf ball) may be held by, or may fall through, the element. And if it goes through the element, it may then be held below the element, (by any means, eg by a tray, or any container element, (or any area)). (The element and/or opening is not limited to having circular characteristics and/or shape, and may be any shape).

Thus various different embodiments of element(s) that comprise a top opening, to aim into, may be provided, not limited to a cup element. The or any such element(s) that comprise a top opening, to aim into, (whether they be holding elements (eg a bag element), or not), may be afforded any of the disclosure and/or feature(s) disclosed with reference to the cup element in the present application. (Thus the or any element(s) that comprise a top opening, to aim into, may, for example, surround the shaft. Thus the or any element(s) that comprise a top opening, to aim into, may, for example, move up and down the shaft, (and, as stated, may draw upon (and be afforded) any of the disclosure and/or feature(s) disclosed with reference to the cup element in the present application). Thus, for example, there may be provided a lid for the element that comprises a top opening. Thus, for example, the element that comprises a top opening may act as a base, to allow the apparatus to stand upright, etc. Thus, for example, the or any element(s) that comprise a top opening, to aim into, may be provided anywhere about the apparatus, (eg may, for example, be attached to the shaft, and/or to the canopy, (or any area(s))).

According to another aspect of the invention, there is provided: an apparatus, comprising: a shaft 12; and an openable and closable canopy 14. According to this aspect, the apparatus may, or may not, comprise a plurality of upwardly extending holding chambers 16 on an underside of the canopy. For example, according to this aspect, the apparatus may have no wall(s). For example, looking at the example of FIG. 1 for example, according to this aspect, there may be no walls. Thus the canopy would provide just one area (and not a plurality of holding chambers), (eg into which to chip a golf ball, for example). Nevertheless, this could still, for example, be used to chip a golf ball into, for example, (or for other functions). The golf ball could then be held in the canopy area, if successfully chipped into it. (As stated, the apparatus is not limited to being used as a golf game, and this explanation is given by way of example only, to aid explanation).

According to this aspect, the apparatus may draw upon, (and therefore comprise), any of the feature(s) disclosed in the present application. Thus it may, for example, comprise a cup element. The cup element may, for example, surround the shaft, etc. Thus, for example, it may comprise a cup element that surrounds the shaft, and wherein the cup element is movable up and down the shaft, etc. (As stated, rather than being limited to a cup element, the apparatus may comprise an element that comprises a top opening, to aim into. And the or any such element(s) that comprise a top opening, to aim into, (whether they be holding elements, or not), may be afforded any of the disclosure and/or feature(s) disclosed with reference to the cup element in the present application).

In Use

An example(s) will now be described in use, described by way of example only, referring to a particularly preferred embodiment(s), in no way limiting a scope of the invention.

Thus, referring in use (by way of example) to a particularly preferred example, the user locates a suitable playing area. This may well be a backyard, or beach area, (but is not limited to these locations). The user removes the lid of the base (which is preferably a cup element, and may be a funnel-type item), and sets aside the contents. (These may include golf balls).

The user undoes any closing mechanism(s) for the canopy, (which may be two straps, for example), and sets aside a chipping mat and flag, fully opening the device just as a user would open an umbrella. The user then turns the umbrella/apparatus upside down and tilts it (or lets it tilt). (In the example embodiment(s) in the Figures, this is preferably done so that the or a holding chamber with the number '3' (and the cup element with the number '1' on it) are facing forward (toward the user). This is best shown in FIG. 5).

It should be noted that various of the holding chambers may be differently coloured and/or annotated. In the example embodiment, for example, the holding chamber(s) with the number '3' may be green, for example. The holding chamber(s) with the number '2' may be light green, for example. The holding chamber(s) with the number '4' may be white (or yellow), for example. The holding chamber(s) with the number '5' may be blue, for example. (These are just examples, and any permutation of colours and/or annotation(s) may be possible, for any holding chamber(s)).

The user then preferably angles the shaft, so that it is straight up.

The user then preferably inserts the anchor staples (which are embodiments of a pinning element(s)) into the grommet holes (shown by way of example in FIG. 5 and FIG. 7, and one of which is shown by way of example (and numbered) in FIG. 7). The grommet holes, (in FIG. 5 and FIG. 7) are shown/suggested to be at inner left and right corners of the example holding chamber labelled with the number '3', but could be located elsewhere.

The user then preferably secures rear left and right lines (which are an example of a back pinning arrangement), best shown in the example of FIG. 5).

The user then inserts the flag/stem into the handle of the apparatus. (This is a preferred method/embodiment of how to attach the flag).

The user then positions the chipping mat at a desired distance away from the canopy, (and, in the example, away from the front of the holding chamber numbered with the number '3', which is at the front, in the example embodiment(s) of the Figures). Recommended distance is 12-15 feet, but shorter or longer distances may, of course, be chosen/carried out. More skilled players may put the chipping mat further away.

A player (or team) then preferably hits nine (or any amount) of the preferably same coloured balls (preferably standard golf balls) towards the target. (The golf balls may be orange, for example). Then perhaps another player (or team) does the same, hitting nine or any amount) of the preferably same coloured balls (preferably standard golf balls) towards the target. (The golf balls may be green, for example). (Thus a player (or team) may hit multiple shots in a row. Alternatively, players (or teams) may hit one shot at a time, with the other player(s) (or team(s)) then hitting, with this then being repeated, for example). Then the player(s) (or teams) can go and tally up their score, for example. They can also collect the ball(s), and then repeat the process, perhaps again hitting balls from the chipping mat. Repeating the process once over would therefore replicate the idea of playing a 'full round' (ie of 18 holes—there being, in the example, a first nine holes (with the first 9 balls), and a second nine holes (with the second 9 balls)). However, the process may be repeated any amount of times, (and with any amount of balls and/or player(s), (eg one or more)), and is not constrained by this example(s).

Ideally, the scoring is done in the following way; if a user gets the ball into the cup element, that represents a 'hole-in-one'. Therefore that is scored as a '1'. (This is why, in the example embodiment(s) of the drawings, there is a number '1' on the cup element, (best shown in FIG. 2). If the user gets the ball into the central/inner holding chamber, that is scored as a '2', which would be a 'birdie' in golf terms, for a par 3, for example). (That is why, in the example embodiment(s), there is a number '2' on/in the central holding chamber, clearly visible in FIGS. 1, 4, 5, and 7). Preferably the central holding chamber is green (preferably light green), to denote/represent a golf green. (A golf green is an area, on golf holes, that tends to have short cut grass, and it is not uncommon for a golfer to score a birdie by putting the ball into the hole in one shot, from the green. A birdie would be a score of '2', on a par 3 golf hole).

Preferably there is a front and a rear/back holding chamber (as shown in the example embodiment(s)), which are numbered (and scored) as a '3'. This is because, if the user gets the ball in these, they have hit a good shot in that it is straight, but it is too long (or short). Therefore it is scored as a 3, which would be a 'par' on a par 3, to use golf terms). (Preferably these holding chamber(s) are green (preferably darker green), to represent they are fairway, or 'rough', but still not bad areas to hit into).

Preferably there is a left and right holding chamber(s), which preferably are white (or yellow), to represent sand (ie a bunker(s)). Preferably hitting into this/these is scored as a '4' (which would be the equivalent of a 'bogey' in golfing terms, on a par 3 golf hole). This is because hitting the ball into a bunker often results, in real golf, in the golfer failing to get 'up-and-down', and therefore scoring a bogey (or sometimes worse). (In the example embodiment(s), examples of such holding chamber(s) can be seen numbered, therefore, with the number '4'.

Preferably there is a corner holding chamber(s), which may be blue (to represent a water hazard, for example), and which may be numbered with the number '5' (as seen in the example embodiment(s) shown). Getting the ball in these may thus be scored as '5' (a double bogey, in golf terms, for a par 3, for example). This is because, if a golfer hits the ball into a water hazard at a par 3, they usually score 5 (or worse).

(If the user misses the apparatus altogether, an even higher score may be apportioned for that shot, (eg 6, (which would be the equivalent, for a par 3, of a triple bogey), or more).

These numbers and/or scores and/or colours are just given by way of example only, and any permutation of any of these things is possible. Furthermore, other numbers and/or colours and/or scores may be used.

Broadly speaking, any of the following colours may denote the following things, and may be used for the apparatus, to denote such things: Green (preferably light green): a golf green; Green (preferably dark green): fairway or rough; White (or yellow): sand (eg a bunker); Blue: a water hazard.

In this example, 18 holes could be played (ie 18 golf balls hit towards the apparatus), and with such a par 3 concept, the overall par score would be seen as 54. Any total score below that would therefore be 'below par', and any total score above that would be 'above par'.

To explain another possible way of scoring, it is feasible, for example, (just to take an example to explain the concept), that getting the ball into the cup element may score the user ten points. Then if they get a ball into the central holding chamber, that might score them less (eg five points). Similarly as before getting the ball into the other holding chambers may score them still less. In this way, a scoring system can be used that, rather than conforming to golf standards, in fact incentivizes the user to get the highest 'points' total possible, and rewards them with more points, depending on how good the shot was, (or at least how good its result was). (Again, it is possible the points for each element are clearly visible on each element. Thus the number '10', for example, could be provided on the cup element, and the holding chambers may also have a number (representing a points amount) on them).

However, the 'par 3' scoring concept (or any scoring concept that conforms more to standard golf scoring) is preferred.

It should be stated, once again, that the example(s) described, in use, is described simply by way of example only, referring to a particularly preferred embodiment(s), and in no way limiting a scope of the invention.

Thus an example(s) has been described, in use.

The embodiments described above are provided by way of example only, and various other modifications will be apparent to persons skilled in the art without departing from the scope of the invention as defined in the appended claims.

Broader and/or Different Invention(s) May be Claimed (and are Supported)

The appended claims define limited inventions. However, it should be recognized and understood that the disclosure of the present application includes a vast array of inventions, not limited to inventions set out in the appended claims and/or any statement(s) of invention.

For example, if the present disclosure of the present application (inclusive of drawing(s) and/or description) discloses features a to z, it should be recognized and understood that any invention may be claimed, comprising any feature(s) out of features a to z. Thus if the/an appended claim 1 defines the invention claimed as comprising essential features a, b, and c, it should be understood that an invention may be claimed comprising solely feature a, or solely feature b, or solely feature c, or any combination of features a, b, and c. Furthermore, it should be understood that an invention may be claimed comprising any of feature(s) d to z, whether or not also comprising any of features a, b, or c.

Furthermore, no feature disclosed is limited to only being set forth in a claim when used in conjunction with other particular feature(s) it is disclosed with in the specification, but may be claimed with any other feature or combination of features disclosed in the present application. Thus if a feature is disclosed 'clustered' with several other feature(s) when disclosed in the specification, the applicant(s) nevertheless reserves the right to 'extract' that feature(s) from the several other feature(s) it is disclosed with, and set it forth in a claim, combined with any other feature(s) disclosed in the present application, which other feature(s) may, or may not, also be 'extracted' from any other feature(s) they are clustered with in the disclosure of the present application. Thus any permutation/combination of features may be claimed for patent in a future claim and/or patent application.

A final claim may be appended, defining/claiming: 'Any novel subject matter or combination including novel subject matter disclosed herein, whether or not within the scope of or relating to the same invention as claimed in any of the preceding claims.', which serves to signify that the applicant(s) reserves the right to claim any invention (ie 'thing'), comprising any feature, or combination of features, disclosed in the present application (inclusive of drawing(s) and/or description). (The applicant(s) reserves this right, whether or not such a claim is appended). This statement (and/or final appended claim), if so desired, should be seen as a statement of invention, stating any invention (ie 'thing'), comprising any feature, or combination of features disclosed in the present application (in any permutation/combination). The applicant(s) reserves the right to claim any (such) invention (ie 'thing'), and considers an objection by a patent office/examiner (stating that such an invention is not supported by/disclosed in the present application) to be in direct conflict with this statement of invention. Thank you to the relevant patent office/examiner for taking note of this. It is intended (or plausible) that such invention(s) may be claimed in a future application(s) which claims benefit of priority of the present application, or, for example, in future filed claims of the present application. The present disclosure of the present application supports such invention(s)/claim(s).

Adjectival and Adverbial Use, in the Present Application, is Innately Optional

In the present application, adjectival definition of a noun in no way limits the ability to claim the noun, without the adjective. Thus if a 'curved edge' is disclosed, it should be understood that it is disclosed simply by way of example, as an embodiment of 'an edge', and that an invention may be claimed, comprising an 'edge', and not limited to comprising a 'curved edge', even if the only disclosure in the specification is of a 'curved edge'. This goes for every single adjective example in the present application, and also applies to adverbs in the same way, with reference to how they limit a broader verb/action, which verb/action/characterizing feature may be included in a claim (and is supported), not limited by the adverb that further defines it.

The Title of the Present Application does not Limit What May be Claimed

The title of the present application (and the claims presented) do not limit what may be claimed futurely, based upon (and supported by) the present application. For example, if the title is 'Pet Cleaning Apparatus', even if all disclosure in the patent application relates to a pet cleaning apparatus (as do the claims), nevertheless, a 'cleaning apparatus' may be claimed (not limited to being for pets), as it is clear a 'pet cleaning apparatus' is an embodiment of a 'cleaning apparatus'. As stated previously, in the present application, adjectival definition of a noun in no way limits the ability to claim the noun, without the adjective. This also applies to the title. Furthermore, an invention may be claimed comprising any feature, or combination of features, disclosed in the present application.

Any Feature Disclosed May be More Broadly Defined/Claimed as a Feature/Arrangement Any feature (for/with a given purpose) disclosed in the present application, whatever it is disclosed or defined as, may be more broadly defined in a claim as a feature (or arrangement) for the given purpose. Thus, if, for example, in the present application, a 'pin' is disclosed, for holding element 'a' and element 'b' together, such disclosure supports definition in a claim (in this, or a future patent application that claims benefit of priority to the present patent application) of a 'holding feature' (or 'holding arrangement'), for holding element 'a' and element 'b' together. This is the case for all feature(s)/disclosure, even including feature(s) defined in any statement(s) of invention and/or title of the invention.

Feature(s) Shown in the Drawings May be Combined to Form an Invention

Any feature(s) or combination of feature(s) shown in any drawing(s) may be combined with any other feature(s) or combination of feature(s) shown in any other drawing(s), to form an invention, which may be claimed. This may be the case for any embodiment shown in any drawing(s), and applicant(s) reserves the right to claim any such invention(s). Furthermore, such feature(s) may, of course, be combined with any other feature(s) and/or disclosure of the present application, to form an invention(s), which may be claimed. Such an invention(s) may be claimed in a future application(s) which claims benefit of priority of the present application, or, for example, in future filed claims of the present application. The present disclosure of the present application supports such invention(s)/claim(s).

The invention claimed is:

1. An apparatus, comprising:

a shaft; and an openable and closable canopy, the canopy having a surface on its underside; and wherein, in use, the apparatus is used with the underside of the canopy facing upwards, the shaft pointing upwardly and extending higher than the canopy;

wherein the apparatus comprises a plurality of upwardly extending holding chambers on the underside of the canopy that said surface provides a respective holding chamber floor for wherein the apparatus, with reference to the upwardly extending holding chambers, comprises a holding chamber wall that has an erect mode, and a non-erect mode.

2. The apparatus of claim 1, wherein the holding chamber wall is self-erecting, going from:

the non-erect mode, when the canopy is closed; to the erect mode when the canopy is opened.

3. The apparatus of claim 2, wherein the apparatus comprises more than one said holding chamber wall that is self-erecting.

4. The apparatus of claim 1, wherein the apparatus comprises more than one said holding chamber wall that has an erect mode and a non-erect mode.

5. The apparatus of claim 1, wherein the apparatus comprises more than one said holding chamber wall that has an erect mode and a non-erect mode, and every one of the more than one said holding chamber wall that has an erect mode and a non-erect mode is self-erecting, going from:

the non-erect mode, when the canopy is closed; to the erect mode when the canopy is opened.

6. The apparatus of claim 1, wherein, of the plurality of upwardly extending holding chambers, there is a central holding chamber, with at least one holding chamber around the central holding chamber.

7. The apparatus of claim 1, wherein, of the plurality of upwardly extending holding chambers, there is a central holding chamber, and a plurality of holding chambers around the central holding chamber.

8. The apparatus of claim 1, wherein a portion or a whole of the shaft can be changed in angle, so that, in use, with the shaft pointing upwards, and the underside of the canopy facing upwards, the portion or the whole of the shaft can be changed in angle, relative to the canopy.

9. The apparatus of claim 8, wherein a part of the shaft is of a material such that the shaft can be bent, to change angle of the portion or the whole of the shaft.

10. The apparatus of claim 8, wherein the shaft comprises a hinge, to facilitate changing angle of the portion or the whole of the shaft.

11. The apparatus of claim 1, wherein the apparatus comprises a cup element, to aim into, the cup element not being the canopy.

12. The apparatus of claim 1, wherein the apparatus comprises a target element that surrounds the shaft, the target element comprising a top opening, to aim into, and wherein the target element, in use, is above the canopy.

13. The apparatus of claim 12, wherein the target element is movable up and down the shaft.

14. The apparatus of claim 13, wherein the apparatus is configured such that the target element moves up and down the shall as the canopy opens and closes, the target element moving up the shaft, as the canopy opens, towards an end of the shaft that, when the canopy is open, is closest to the canopy, and the target element moving down the shaft, as the canopy closes.

15. The apparatus of claim 13, wherein the target element is movable down the shaft, towards an end of the shaft that, when the canopy is open, is furthest from the canopy, to a low position, and is able to act as a base, in the low position, that allows the apparatus to stand upright.

16. The apparatus of claim 12, wherein the apparatus comprises a lid for the target element.

17. The apparatus of claim 16, wherein the lid for the target element is removable.

18. The apparatus of claim 12, wherein the target element that comprises the top opening, to aim into, is a holding element.

19. The apparatus of claim 18, wherein the holding element is a cup element.

20. The apparatus of claim 1, wherein there is provided a pinning arrangement, to pin the canopy to a ground, wherein the pinning arrangement provides a downward force to the canopy, to pin the canopy to the ground, the canopy itself experiencing downward force from the pinning arrangement.

21. The apparatus of claim 20, wherein the pinning arrangement comprises a front pinning arrangement, for pinning a front of the canopy to the ground, wherein the front pinning arrangement provides a downward force to the front of the canopy, to pin the front of the canopy to the ground, the front of the canopy itself experiencing downward force from the front pinning arrangement.

22. The apparatus of claim 21, wherein the front pinning arrangement comprises an aperture in the canopy within one of the holding chambers, and a pinning element that goes through the aperture, to facilitate pinning the front of the canopy to the ground.

23. The apparatus of claim 20, wherein the pinning arrangement comprises a back pinning arrangement, for pinning a back of the canopy to the ground, wherein the back pinning arrangement provides a downward force to the back of the canopy, to pin the back of the canopy to the ground, the back of the canopy itself experiencing downward force from the back pinning arrangement.

24. The apparatus of claim 20, wherein the pinning arrangement comprises both:

a front pinning arrangement, for pinning a front of the canopy to the ground, wherein the front pinning arrangement provides a downward force to the front of the canopy, to pin the front of the canopy to the ground, the front of the canopy itself experiencing downward force from the front pinning arrangement; and a back pinning arrangement, for pinning a back of the canopy to the ground, wherein the back pinning arrangement provides a downward force to the back of the canopy, to pin the back of the canopy to the ground, the back of the canopy itself experiencing downward force from the back pinning arrangement.

25. The apparatus of claim 20, wherein the pinning arrangement comprises an aperture in the canopy within one of the holding chambers, and a pinning element that goes through the aperture, to facilitate pinning the canopy to the ground.

* * * * *